US010760245B2

(12) United States Patent
Morita et al.

(10) Patent No.: US 10,760,245 B2
(45) Date of Patent: Sep. 1, 2020

(54) DRIVE CONTROL DEVICE FOR CONSTRUCTION MACHINE

(71) Applicant: HITACHI CONSTRUCTION MACHINERY CO., LTD., Tokyo (JP)

(72) Inventors: Yuuichirou Morita, Hitachi (JP); Manabu Edamura, Kasumigaura (JP); Kouji Ishikawa, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 276 days.

(21) Appl. No.: 15/755,103

(22) PCT Filed: Mar. 31, 2016

(86) PCT No.: PCT/JP2016/060688
§ 371 (c)(1),
(2) Date: Feb. 26, 2018

(87) PCT Pub. No.: WO2017/168686
PCT Pub. Date: Oct. 5, 2017

(65) Prior Publication Data

US 2018/0266079 A1 Sep. 20, 2018

(51) Int. Cl.
*E02F 9/20* (2006.01)
*E02F 9/22* (2006.01)
(Continued)

(52) U.S. Cl.
CPC ..... *E02F 9/2033* (2013.01); *E02F 3/435* (2013.01); *E02F 9/20* (2013.01); *E02F 9/2004* (2013.01);
(Continued)

(58) Field of Classification Search
CPC . E02F 3/435; E02F 3/32; E02F 9/2004; E02F 9/22; E02F 9/26; E02F 9/2033; E02F 9/20; E02F 9/2228
See application file for complete search history.

(56) References Cited

U.S. PATENT DOCUMENTS 6,169,948 B1 * 1/2001 Fujishima ..... E02F 3/435 701/50
6,275,757 B1 * 8/2001 Watanabe ..... E02F 3/437 172/6
(Continued)

FOREIGN PATENT DOCUMENTS

JP 2004-239303 A 8/2004
JP 2006-104836 A 4/2006
(Continued)

OTHER PUBLICATIONS

International Search Report of PCT/JP2016/060688 dated Jul. 5, 2016.

*Primary Examiner* — Thomas G Black
*Assistant Examiner* — Demetra R Smith-Stewart
(74) *Attorney, Agent, or Firm* — Mattingly & Malur, PC

(57) ABSTRACT

An area limit control part as a control section outputs a requested boost pilot pressure for driving a control valve, based upon a pilot pressure in accordance with an operating amount of an operating lever and a posture signal of a posture sensor. A drive permission determination part determines whether or not a drive of a hydraulic actuator is permitted based upon the pilot pressure in accordance with the operating amount of the operating lever. A pilot pressure selecting part selects the requested boost pilot pressure from the area limit control part in such a manner as to drive the control valve with the requested boost pilot pressure to the
(Continued)

hydraulic actuator the drive of which is permitted, and not to drive the control valve to the hydraulic actuator the drive of which is not permitted.

6 Claims, 19 Drawing Sheets

(51) Int. Cl.
*E02F 9/24* (2006.01)
*E02F 9/26* (2006.01)
*E02F 3/43* (2006.01)
*E02F 3/32* (2006.01)

(52) U.S. Cl.
CPC ..... *E02F 9/22* (2013.01); *E02F 9/2228* (2013.01); *E02F 9/24* (2013.01); *E02F 9/26* (2013.01); *E02F 3/32* (2013.01)

(56) References Cited

U.S. PATENT DOCUMENTS

| | | | | |
|---|---|---|---|---|
| 2010/0011757 | A1* | 1/2010 | Satake | E02F 3/965 60/459 |
| 2013/0317710 | A1 | 11/2013 | Sakurai et al. | |
| 2015/0027112 | A1* | 1/2015 | Takebayashi | E02F 9/2225 60/393 |
| 2015/0044007 | A1 | 2/2015 | Tajima et al. | |
| 2018/0051444 | A1* | 2/2018 | Yamashita | E02F 9/226 |
| 2018/0080196 | A1* | 3/2018 | Kondo | E02F 9/226 |

FOREIGN PATENT DOCUMENTS

| | | | |
|---|---|---|---|
| JP | 2012-017626 | A | 1/2012 |
| JP | 2012-172467 | A | 9/2012 |
| JP | 2013-147886 | A | 8/2013 |
| JP | 2013-163959 | A | 8/2013 |
| JP | 2013-167098 | A | 8/2013 |

* cited by examiner

Fig.5

60

| | | DRIVE PERMISSION TARGET | | | | | | | |
|---|---|---|---|---|---|---|---|---|---|
| | | RIGHT REVOL. | LEFT REVOL. | BOOM RAISING | BOOM LOWER. | ARM PUSHING | ARM PULLING | BUCKET EXCAVAT. | BUCKET SOIL DISC. |
| LEVER OPERATION | RIGHT REVOLUTION | PERMIT | | | | | | | |
| | LEFT REVOLUTION | | PERMIT | | | | | | |
| | BOOM RAISING | | | PERMIT | | | | | |
| | BOOM LOWERING | | | | PERMIT | | | | |
| | ARM PUSHING | | | PERMIT | | PERMIT | | | |
| | ARM PULLING | | | PERMIT | | | PERMIT | | |
| | BUCKET EXCAVATING | | | PERMIT | | | | PERMIT | |
| | BUCKET SOIL DISCHARG. | | | PERMIT | | | | | PERMIT |

Fig.6

60

| | | DRIVE PERMISSION TARGET | | | | | | | |
|---|---|---|---|---|---|---|---|---|---|
| | | RIGHT REVOL. | LEFT REVOL. | BOOM RAISING | BOOM LOWER. | ARM PUSH. | ARM PULL. | BUCKET EXCAV. | BUCKET SOIL DISC. |
| LEVER OPERATION | RIGHT REVOL. | PERMIT | | | | | | | |
| | LEFT REVOL. | | PERMIT | | | | | | |
| | BOOM RAISING | | | PERMIT | | | | | |
| | BOOM LOWERING | | | | PERMIT | | | | |
| | ARM PUSHING | | | PERMIT | | PERMIT | | | |
| | ARM PULLING | | | PERMIT | | | PERMIT | | |
| | BUCKET EXCAVAT. | | | PERMIT | | | | PERMIT | |
| | BUCKET SOIL DISC. | | | PERMIT | | | | | PERMIT |

| | DRIVE PERMISSION TARGET | | | | | | | |
|---|---|---|---|---|---|---|---|---|
| | RIGHT REVOL. | LEFT REVOL. | BOOM RAISING | BOOM LOWER. | ARM PUSH. | ARM PULL. | BUCKET EXCAV. | BUCKET SOIL DISC. |
| DETERMINAT. RESULT | | | PERMIT | | | PERMIT | PERMIT | |

Fig.8

62

| | | DRIVE PERMISSION TARGET | | | | | | | |
|---|---|---|---|---|---|---|---|---|---|
| | | RIGHT REVOL. | LEFT REVOL. | BOOM RAISING | BOOM LOWER. | ARM PUSHING | ARM PULLING | BUCKET EXCAV. | BUCKET SOIL DISC. |
| LEVER OPERATION | RIGHT REVOLUTION | PERMIT | | | | | | | |
| | LEFT REVOLUTION | | PERMIT | | | | | | |
| | BOOM RAISING | | | PERMIT | | PERMIT | | | |
| | BOOM LOWERING | | | | PERMIT | PERMIT | | | |
| | ARM PUSHING | | | | | PERMIT | | | |
| | ARM PULLING | | | | | | PERMIT | | |
| | BUCKET EXCAVATING | | | | | PERMIT | | PERMIT | |
| | BUCKET SOIL DISCHARGING | | | | | | | | PERMIT |

Fig.9

62

| | | DRIVE PERMISSION TARGET | | | | | | | |
|---|---|---|---|---|---|---|---|---|---|
| | | RIGHT REVOL. | LEFT REVOL. | BOOM RAISING | BOOM LOWER. | ARM PUSH. | ARM PULL. | BUCKET EXCAV. | BUCKET SOIL DISC. |
| LEVER OPERATION | RIGHT REVOL. | PERMIT | | | | | | | |
| | LEFT REVOL. | | PERMIT | | | | | | |
| | BOOM RAISING | | | PERMIT | | PERMIT | | | |
| | BOOM LOWER. | | | | PERMIT | PERMIT | | | |
| | ARM PUSHING | | | | | PERMIT | | | |
| | ARM PULLING | | | | | | PERMIT | | |
| | BUCKET EXCAVAT. | | | | | PERMIT | | PERMIT | |
| | BUCKET SOIL DISC. | | | | | | | | PERMIT |

| | DRIVE PERMISSION TARGET | | | | | | | |
|---|---|---|---|---|---|---|---|---|
| | RIGHT REVOL. | LEFT REVOL. | BOOM RAISING | BOOM LOWER. | ARM PUSH. | ARM PULL. | BUCKET EXCAV. | BUCKET SOIL DISC. |
| DETERMINAT. RESULT | | | PERMIT | | PERMIT | | PERMIT | |

Fig.15

90

| | | PILOT PRESSURE UPPER LIMIT VALUE OF EACH TARGET | | | | | | | |
|---|---|---|---|---|---|---|---|---|---|
| | | RIGHT REVOL. | LEFT REVOL. | BOOM RAISING | BOOM LOWER. | ARM PUSHING | ARM PULLING | BUCKET EXCAV. | BUCKET SOIL DISC. |
| LEVER OPERATION | RIGHT REVOL. | Ca | 0 | 0 | 0 | 0 | 0 | 0 | 0 |
| | LEFT REVOL. | 0 | Ca | 0 | 0 | 0 | 0 | 0 | 0 |
| | BOOM RAISING | 0 | 0 | Ca | 0 | 0 | 0 | 0 | 0 |
| | BOOM LOWERING | 0 | 0 | 0 | Ca | 0 | 0 | 0 | 0 |
| | ARM PUSHING | 0 | 0 | Ca | 0 | Ca | 0 | 0 | 0 |
| | ARM PULLING | 0 | 0 | Ca | 0 | 0 | Ca | 0 | 0 |
| | BUCKET EXCAVATING | 0 | 0 | Cb | 0 | 0 | 0 | Ca | 0 |
| | BUCKET SOIL DISC. | 0 | 0 | Cb | 0 | 0 | 0 | 0 | Ca |

Fig.16

90

| LEVER OPERATION | PILOT PRESSURE UPPER LIMIT VALUE OF EACH TARGET | | | | | | | | LEVER OPERATING AMOUNT |
|---|---|---|---|---|---|---|---|---|---|
| | RIGHT REVOL. | LEFT REVOL. | BOOM RAIS. | BOOM LOWER. | ARM PUSH. | ARM PULL. | BUCKET EXCAV. | BUCKET SOIL DISC. | |
| RIGHT REVOL. | Ca | 0 | 0 | 0 | 0 | 0 | 0 | 0 | |
| LEFT REVOL. | 0 | Ca | 0 | 0 | 0 | 0 | 0 | 0 | |
| BOOM RAISING | 0 | 0 | Ca | 0 | 0 | 0 | 0 | 0 | |
| BOOM LOWER. | 0 | 0 | 0 | Ca | 0 | 0 | 0 | 0 | |
| ARM PUSHING | 0 | 0 | Ca | 0 | Ca | 0 | 0 | 0 | |
| ARM PULLING | 0 | 0 | Ca | 0 | 0 | Ca | 0 | 0 | v3 |
| BUCKET EXCAVAT. | 0 | 0 | Cb | 0 | 0 | 0 | Ca | 0 | v4 |
| BUCKET SOIL DISC. | 0 | 0 | Cb | 0 | 0 | 0 | 0 | Ca | |

| | PILOT PRESSURE UPPER LIMIT VALUE OF EACH TARGET | | | | | | | |
|---|---|---|---|---|---|---|---|---|
| | RIGHT REVOL. | LEFT REVOL. | BOOM RAIS. | BOOM LOWER. | ARM PUSH. | ARM PULL. | BUCKET EXCAV. | BUCKET SOIL DISC. |
| PERMISSION CONTROL PRESSURE | 0 | 0 | Ppa3 | 0 | 0 | Ppa3 | Ppa4 | 0 |

DRIVE CONTROL DEVICE FOR CONSTRUCTION MACHINE

TECHNICAL FIELD

The present invention relates to a drive control device for a construction machine suitable for use in a construction machine such as a hydraulic excavator and the like, for example.

BACKGROUND ART

For example, a construction machine such as a hydraulic excavator can perform excavation by a working mechanism (front) composed of a boom, an arm, a bucket and the like, travel of a machine by a lower traveling structure, revolution of an upper revolving structure and the like. Therefore, the hydraulic excavator is provided with an operating lever that is operated by an operator to perform the excavation, the travel, the revolution and the like, a plurality of hydraulic actuators for performing these movements of the excavation, the travel, the revolution and the like, a main pump that delivers pressurized oil for driving each of the hydraulic actuators, an engine that drives the main pump, a plurality of control valves that distribute the pressurized oil to each of the hydraulic actuators in response to the lever operating of an operator, and a pilot pump that is driven by the engine to generate a pilot pressure for controlling opening/closing of the control valve. This construction machine controls the pilot pressure in accordance with the operating amount of the operating lever to distribute the pressurized oil to each of the hydraulic actuators in response to the lever operation by an operator, thus enabling the machine to move according to an intent of the operator.

Here, general hydraulic excavators control the pilot pressure by a hydraulic circuit. In this case, some of the hydraulic excavators are designed such that control by a controller is added to the control of the pilot pressure to prevent the hydraulic excavator from excavating excessively over a preset target excavating surface or the bucket from colliding with a vehicle body including a cab of the hydraulic excavator. This type of hydraulic excavator is provided with a posture sensor (for example, an tilt angle sensor, a potentiometer or the like) that measures a posture of the vehicle body or the working mechanism, a pressure sensor that measures a pilot pressure in accordance with an operating amount of the operating lever, a proportional solenoid valve that reduces the pilot pressure generated in accordance with the lever operating amount, another proportional solenoid valve that increases the pilot pressure regardless of the lever operation, and a controller that drives the proportional solenoid valve based upon posture information of the vehicle body or the working mechanism by the posture sensor and lever operating information by the pressure sensor. In this case, the controller corrects the movement of the working mechanism by reducing or increasing the pilot pressure in such a manner as to prevent the working mechanism from deviating from a predetermined spacious area when an operator operates the working mechanism.

On the other hand, there are some hydraulic excavators in which an electrical lever is adopted as the operating lever, and the pilot pressure is controlled only by the controller without providing a hydraulic circuit for controlling the pilot pressure. This hydraulic excavator is provided with the electrical lever that outputs an electrical operating signal in accordance with a lever operating amount, a proportional solenoid valve that controls pilot pressures of a plurality of hydraulic actuators, and a controller that drives the proportional solenoid valve based upon an operating signal that is outputted by the electrical lever. In this case, the controller controls each of the hydraulic pilot pressures in accordance with the lever operating amount to operate the machine. Further, there are other hydraulic excavators that are provided with a posture sensor that measures a posture of the vehicle body or the working mechanism. In this case, the controller controls the pilot pressure of each of the hydraulic actuators such that the working mechanism does not deviate from a predetermined spacious area, making it possible to operate the working mechanism.

These hydraulic excavators have a possibility that in a case where some malfunction occurs or noises are mixed in the controller, the controller drives the proportional solenoid valve in error. In this case, even when the operating lever is returned back to a neutral position, the machine does not stop possibly. In contrast thereto, for example, Patent Document 1 discloses a drive control device of a hydraulic machine that is provided with an electrical lever that outputs a lever operating amount signal in accordance with an operating amount, a neutral position signal outputting section configured to output a neutral position signal when the electrical lever is in a neutral position, a controller that drives a proportional solenoid valve that controls a pilot pressure of each of the actuators, based upon the lever operating amount signal, and a blockade device that performs an on/off operation of a drive signal between the controller and the proportional solenoid valve based upon the neutral position signal. The blockade device blocks the drive signal of the proportional solenoid valve of the concerned actuator when the operating lever of each of the actuators is in the neutral position. Accordingly, even when abnormality of the controller occurs, it is possible to stop the machine by returning the operating lever to the neutral position.

PRIOR ART DOCUMENT

Patent Document

Patent Document 1: Japanese Patent Laid-Open No. Hei 01-97729 A

SUMMARY OF THE INVENTION

The drive control device according to Patent Document 1 can drive the actuator the lever operation of which is performed by an operator. However, the drive control device cannot drive the actuator the operating lever of which is in the neutral position since the drive signal of the proportional solenoid valve is blocked out. On the other hand, in a case of controlling the working mechanism such that the working mechanism does not deviate from the predetermined spacious area, the actuator corresponding to the lever in the neutral position that an operator is not operating is required to be controlled by the controller.

Therefore, the drive control device according to Patent Document 1 cannot control the working mechanism such that the working mechanism does not deviate from the predetermined spacious area. It should be noted that it is conceived to apply the technology in Patent Document 1 to the hydraulic excavator that controls the pilot pressure in response to the lever operation in the hydraulic circuit. In this case as well, however, the proportional solenoid valve that increases the pilot pressure regardless of the lever operation cannot be controlled by the controller such that the working mechanism does not deviate from the predetermined spacious area, creating a problem as similar to the above.

An object of the present invention is to provide a drive control device for a construction machine that can stop a machine by setting an operating lever to a neutral position whether a controller (control section) is normal or not, and can control a working mechanism from deviating from a predetermined spacious area.

A drive control device for a construction machine according to the present invention is provided with a plurality of operating levers that operate a plurality of hydraulic actuators provided in a machine; an operating amount measuring section configured to output an operating signal in accordance with an operating amount of each of the operating levers; a posture measuring section configured to output a posture signal in accordance with a posture of the machine; a plurality of control valves that control a drive of each of the hydraulic actuators; and a control section configured to output a drive signal for driving each of the control valves based upon the operating signal and the posture signal.

For solving the aforementioned problems, the configuration adopted by the invention defined in claim 1 characterized in including a drive permission determination section configured to determine whether or not the drive of each of the hydraulic actuators is permitted based upon the operating signal; and a drive signal selecting section configured to select the drive signal in such a manner as to drive the control valve with the drive signal to the hydraulic actuator the drive of which is permitted by the drive permission determination section, and not to drive the control valve to the hydraulic actuator the drive of which is not permitted by the drive permission determination section.

On the other hand, the configuration adopted by the invention defined in claim 4 is characterized in that: the drive control device for the construction machine includes: a drive signal upper limit determination section configured to determine an upper limit value of the drive signal for driving the control valve of each of the hydraulic actuators based upon the operating signal; and a drive signal selecting section configured to select the drive signal in such a manner as to drive the control valve with the drive signal to the hydraulic actuator the drive signal of which is equal to or less than the upper limit value determined by the drive signal upper limit determination section, and to drive the control valve with the upper limit value to the hydraulic actuator the drive signal of which is beyond the upper limit value determined by the drive signal upper limit determination section.

The drive control device for the construction machine according to the present invention can stop the machine by setting the operating lever to the neutral position whether the control section is normal or not, and can control the working mechanism from deviating from the predetermined spacious area.

BRIEF DESCRIPTION OF THE DRAWINGS

FIG. 5 is an explanatory diagram of a drive permission setting table showing an example of a relation between a lever operation and a drive permission target.

FIG. 6 is an explanatory diagram showing a use example (determination example) of the drive permission setting table in FIG. 5.

FIG. 8 is an explanatory diagram of a drive permission setting table showing another example of a relation between the lever operation and the drive permission target.

FIG. 9 is an explanatory diagram showing a use example (determination example) of the drive permission setting table in FIG. 8.

FIG. 15 is an explanatory diagram of a drive upper limit value setting table showing an example of a relation between a lever operation and a pilot pressure upper limit value of each of actuator drives.

FIG. 16 is an explanatory diagram showing a use example (determination example) of the drive upper limit value setting table in FIG. 15.

MODE FOR CARRYING OUT THE INVENTION

Hereinafter, an explanation will be in detail made of an embodiment of a drive control device for a construction machine according to the present invention with reference to the accompanying drawings, by taking a case of being applied to a hydraulic excavator as an example.

Figure 1:
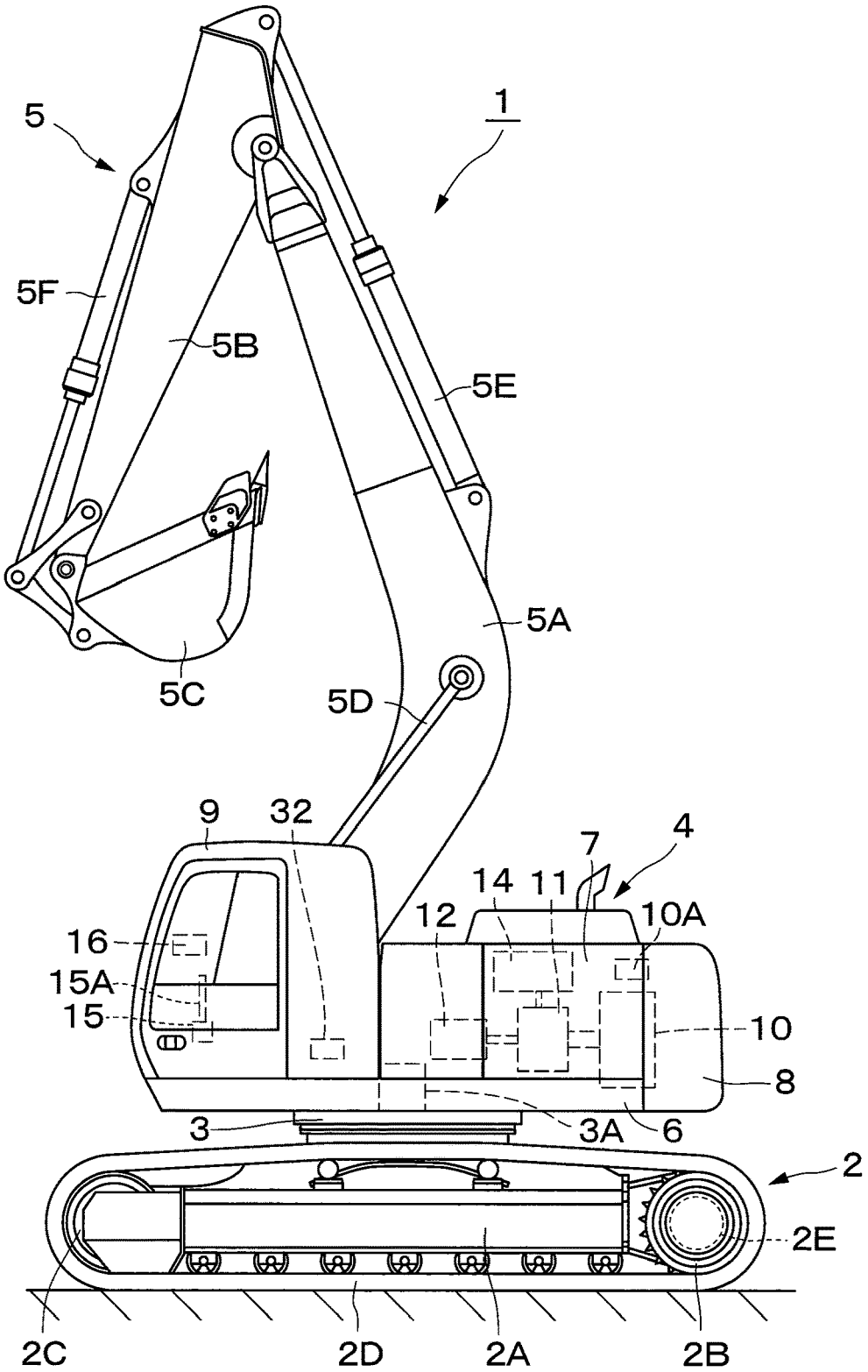
FIG. 1 is a front view showing a hydraulic excavator according to a first embodiment of the present invention.

FIG. 1 to FIG. 12 show a first embodiment. In FIG. 1, a hydraulic excavator 1 that is a representative example of construction machines includes an automotive lower traveling structure 2 of a crawler type, an upper revolving structure 4 that is rotatably mounted on the lower traveling structure 2 through a revolving device 3, and a working mechanism 5 that is tiltably provided in the front side of the upper revolving structure 4 in a front-rear direction. The lower traveling structure 2, the revolving device 3 and the upper revolving structure 4 configure a vehicle body of the hydraulic excavator 1, and the lower traveling structure 2, the revolving device 3, the upper revolving structure 4 and the working mechanism 5 configure a machine (construction machine).

Here, the lower traveling structure 2 includes a truck frame 2A, a drive wheel 2B provided on each of both sides of the truck frame 2A in a left-right direction, an idler wheel 2C provided on each of both the sides of the truck frame 2A in the left-right direction in the opposite side to the drive wheel 2B in the front-rear direction and a crawler belt 2D wound around and between each of the drive wheels 2B and each of the idler wheels 2C (only the left components of the above are shown). The left and right drive wheels 2B are respectively connected to left and right traveling hydraulic motors 2E (only the left motor is shown) through a reduction mechanism. That is, the drive wheel 2B is driven and rotated by the traveling hydraulic motor 2E. On this occasion, the traveling hydraulic motor 2E configures a hydraulic actuator that causes the hydraulic excavator 1 as a vehicle to move/travel.

The revolving device 3 is disposed on the lower traveling structure 2. The revolving device 3 includes, for example, revolving bearings, a reduction mechanism (any of them is not shown) and a revolving hydraulic motor 3A. The revolving device 3 revolves the upper revolving structure 4 to the lower traveling structure 2. At this time, the revolving hydraulic motor 3A configures a hydraulic actuator that operates/revolves the upper revolving structure 4 together with the working mechanism 5.

The working mechanism 5 configures an excavating mechanism that is a front of the hydraulic excavator 1. The working mechanism 5 is provided with, for example, a boom 5A, an arm 5B and a bucket 5C as a working tool (attachment), and a boom cylinder 5D, an arm cylinder 5E and a bucket cylinder 5F as a working tool cylinder, which drive the above components. The boom 5A, the arm 5B and the bucket 5C are pinned to each other. The working mechanism 5 can perform the excavating work with expansion or contraction of each of the cylinders 5D, 5E, 5F. At this time, each of the cylinders 5D, 5E, 5F configures a hydraulic actuator that operates/excavates the working mechanism 5.

That is, the boom cylinder 5D, the arm cylinder 5E and the bucket cylinder 5F that are composed of the hydraulic cylinders, and the left and right traveling hydraulic motors 2E and the revolving hydraulic motor 3A that are composed of the hydraulic motors respectively configure hydraulic actuators (hydraulic equipment and hydraulic devices) that are driven (operable) based upon delivery of pressurized oil. The plurality of hydraulic actuators 5D, 5E, 5F, 2E, 3A are provided in the machine (construction machine) including the lower traveling structure 2, the revolving device 3, the upper revolving structure 4 and the working mechanism 5.

The upper revolving structure 4 is provided with a revolving frame 6 formed as a support structural body on the front side in the front-rear direction of which the working mechanism 5 is mounted, a housing cover 7 that accommodates an engine 10, a main pump 11, a pilot pump 12, a control valve device 14 and the like that are disposed on the revolving frame 6, a counterweight 8 that acts as a weight balance to the working mechanism 5 and a cab 9 on which an operator boards.

Here, the engine 10 is configured by using an internal combustion engine such as a diesel engine, for example. The main pump 11 as a hydraulic pump and the pilot pump 12 as another hydraulic pump are connected mechanically to an output side of the engine 10. A rotational number (rotational speed) and a driving force of the engine 10 are controlled by controlling a fuel injection quantity by an engine controller 10A also called an ECU. The engine controller 10A is connected to a main controller 32 as described later.

The driving force of the engine 10 is transmitted to the main pump 11 and the pilot pump 12. Accordingly, the engine 10 configures a prime mover (rotational source or drive source) for driving/rotating the main pump 11 and the pilot pump 12. It should be noted that the prime mover that drives the main pump 11 and the pilot pump 12 can be configured with an engine unit as an internal combustion engine, and besides, may be configured with, for example, an engine and an electric motor or an electric motor unit.

The main pump 11 is driven/rotated by the engine 10. The main pump 11 configures a main hydraulic source together with a hydraulic oil tank 13 (refer to FIG. 2) for reserving hydraulic oil. The main pump 11 is configured by, for example, a variable displacement swash plate hydraulic pump, and has a regulator (capacity variable part or tilt actuator) 11A (refer to FIG. 2) that adjusts a pump capacity. The regulator 11A is connected to the main controller 32 (vehicle body control part 36 thereof), and is variably controlled by the main controller 32 (vehicle body control part 36 thereof). That is, the pump capacity of the main pump 11 is adjusted by the main controller 32. The main pump 11 is driven/rotated by the engine 10 to deliver pressurized oil to each of the hydraulic actuators 5D, 5E, 5F, 2E, 3A through the control valve device 14.

The pilot pump 12 is driven/rotated by the engine 10 as similar to the main pump 11. The pilot pump 12 is configured as, for example, a fixed displacement hydraulic pump, and configures a pilot hydraulic source together with the hydraulic oil tank 13. The pilot pump 12 delivers a pilot pressure to the control valve device 14 through an operating lever device 15 provided in the inside of the cab 9.

The control valve device 14 distributes the pressurized oil generated by the main pump 11 to each of the hydraulic actuators 5D, 5E, 5F, 2E, 3A. Therefore, the control valve device 14 is provided between the main pump 11 and each of the hydraulic actuators 5D, 5E, 5F, 2E, 3A. The control valve device 14 is a group of control valves configured by a plurality of control valves 14A (refer to FIG. 2). Each of the control valves 14A is configured by a directional control valve having six ports and three positions, for example, and switches/controls the pressurized oil to be delivered to each of the hydraulic actuators 5D, 5E, 5F, 2E, 3A from the main pump 11.

In this case, the control valve device 14 (each of the control valves 14A) is operated (switched) by the operating lever device 15. Therefore, a pair of hydraulic pilot parts (not shown) is provided in each of the control valves 14A in the control valve device 14, respectively. A pilot pressure (switching signal) is supplied to the hydraulic pilot part of the control valve 14A based upon an operation of the operating lever device 15. Accordingly, each of the control valves 14A controls a drive of each of the hydraulic actuators 5D, 5E, 5F, 2E, 3A.

An operator's seat (not shown) on which an operator is seated, the plurality of operating lever device 15 to be operated by an operator, a monitor/operating panel device 16 that notifies an operator of various information of the machine and sets a drive mode and the like, and the like are provided in the inside of the cab 9. In addition, the main controller 32 is provided in the inside of the cab 9 to control the main pump 11 and the control valve device 14 and give a command to the engine controller 10A. It should be noted that in FIG. 1, the main controller 32 is provided in the inside of the cab 9 of the upper revolving structure 4, but the main controller 32 may be provided, for example, outside of the cab 9 of the upper revolving structure 4.

The plurality of operating lever devices 15 are configured of an operating lever/pedal device for travel, an operating lever device for work, and the like. That is, each of the operating lever devices 15 is configured as a pilot operating valve (hydraulic type lever device) composed of a pressure reducing valve type pilot valve, for example, and is provided with an operating lever 15A to be operated by an operator. The operating lever device 15 including the operating lever 15A is to operate each of the hydraulic actuators 5D, 5E, 5F, 2E, 3A.

That is, when an operator manually performs atilt operation (lever operation) of the operating lever 15A, a pilot pressure (switch hydraulic signal) in proportion to an operating amount of the operating lever 15A is supplied to each of the control valves 14A (hydraulic pilot part thereof) configuring the control valve device 14 from the operating lever device 15. As a result, a position of a spool in each of the control valves 14A is displaced to control a direction and a flow amount of the pressurized oil to be supplied/discharged to each of the hydraulic actuators 5D, 5E, 5F, 2E, 3A, thus making it possible to perform excavation by the working mechanism 5, travel of the lower traveling structure 2, revolution of the upper revolving structure 4, and the like.

The monitor/operating panel device 16 aims at informing an operator of a state of the machine concerning a fuel remaining amount, an engine cooling water temperature and the like, as well as selecting and setting a driving mode of the hydraulic excavator 1, and the like. Therefore, the monitor/operating panel device 16 includes, for example, a liquid crystal monitor as a display screen, an acoustic device that outputs sounds, and an operating panel as an input interface of an operator. When the monitor/operating panel device 16 informs an operator of abnormality, the monitor/operating panel device 16 displays occurrence of the abnormality, a content of the abnormality and the like on the display screen and/or outputs sounds such as a warning sound, a voice and the like from the acoustic device.

Next, an explanation will be made of a hydraulic circuit 21 for driving the hydraulic excavator 1 with reference to FIG. 2 in addition to FIG. 1. It should be noted that in FIG. 2, for avoiding complication of the figure, plural pieces of hydraulic equipment are represented by one piece of equipment. Specifically, in FIG. 2, the plurality of control valves 14A configuring the control valve device 14 are represented by one control valve 14A, and the plurality of the hydraulic actuators 5D, 5E, 5F, 2E, 3A are represented by one hydraulic actuator (hereinafter, referred to as "hydraulic actuator 22"), the plurality of operating lever devices 15 are represented by one operating lever device 15, a plurality of pressure-reduction proportional solenoid valves 23 are represented by one pressure-reduction proportional solenoid valve 23 and a plurality of boost proportional solenoid valves 25 are represented by one boost proportional solenoid valve 25.

The hydraulic circuit 21 in the actual hydraulic excavator 1 is provided with, for example, the six hydraulic actuators 22, the six control valves 14A, the four operating lever devices 15 (for example, the two operating lever devices for work corresponding to a total of four directions and the two lever/pedal devices for travel), the four or six pressure-reduction proportional solenoid valves 23 and the four or six boost proportional solenoid valves 25. In addition, in FIG. 2, a plurality of pressure sensors 28 and a plurality of other pressure sensors 29 as well to be described later each are represented by one sensor. The hydraulic circuit 21 in the actual hydraulic excavator 1 is provided with, for example, the four or six pressure sensors 28 and the other pressure sensors 29, respectively.

Figure 2:
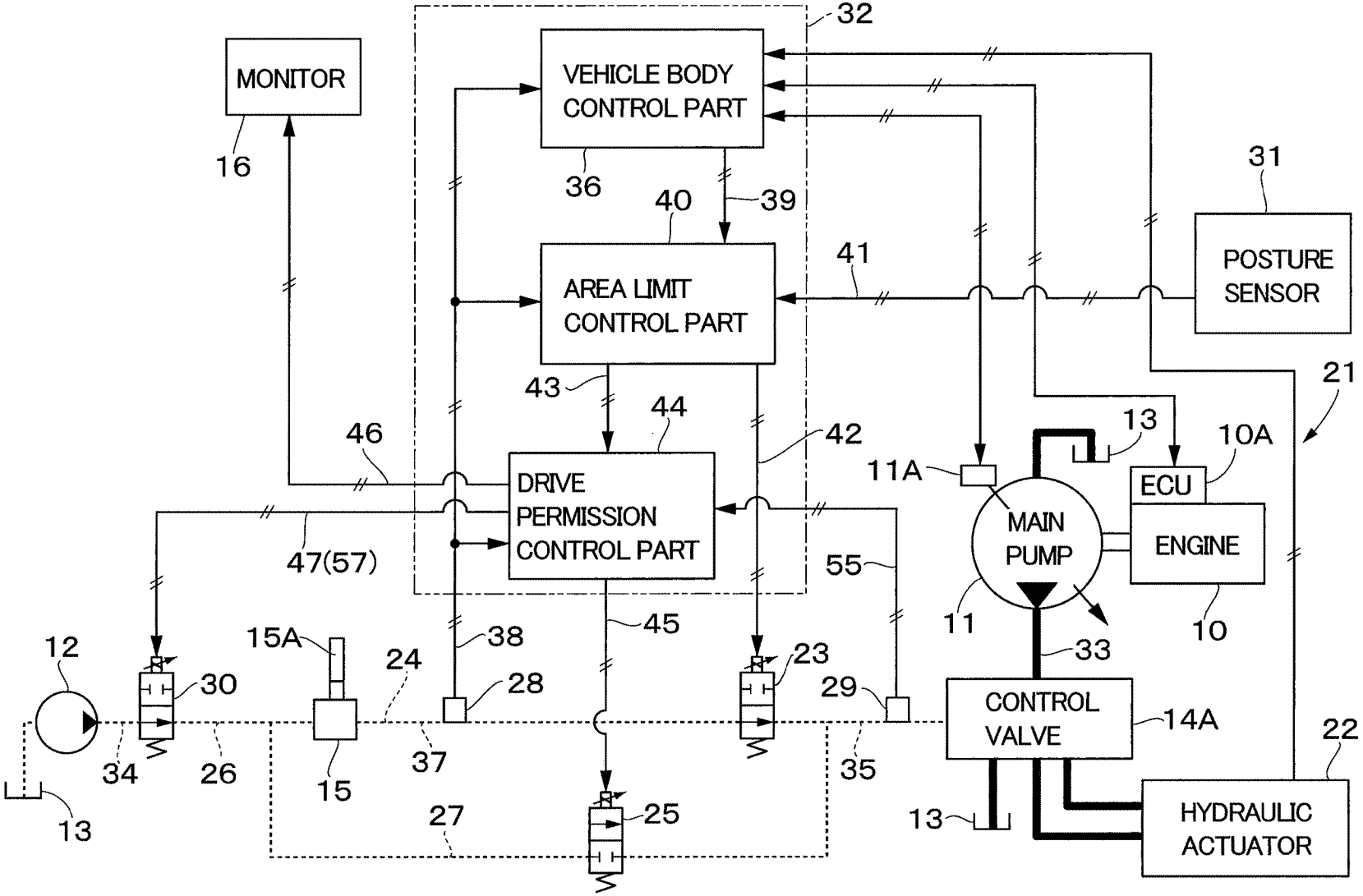
FIG. 2 is a block diagram schematically showing a hydraulic system (hydraulic circuit) and an electrical system (control circuit) of the hydraulic excavator.

As shown in FIG. 2, the hydraulic circuit 21 in the hydraulic excavator 1 is provided with the engine 10, the main pump 11, the plurality of control valves 14A, the plurality of hydraulic actuators 22, the pilot pump 12, the plurality of operating lever devices 15, the plurality of pressure-reduction proportional solenoid valves 23, the plurality of boost proportional solenoid valves 25, the plurality of pressure sensors 28, the plurality of other pressure sensors 29, a blockade solenoid valve 30, a posture sensor 31, the main controller 32 and the monitor/operating panel device 16.

The pressure-reduction proportional solenoid valve 23 is provided between the operating lever device 15 and the control valve 14A (the pilot part thereof). That is, the pressure-reduction proportional solenoid valve 23 is provided on the way of a pilot line 24 connecting between the operating lever device 15 and the control valve 14A. The pressure-reduction proportional solenoid valve 23 is configured by a regular opening proportional solenoid valve, for example, and is connected to the main controller 32 (an area limit control part 40 thereof). The pressure-reduction proportional solenoid valve 23 reduces the pilot pressure to be supplied to the control valve 14A (a pilot part thereof) based upon a command (drive signal) of the main controller 32.

The boost proportional solenoid valve 25 is provided between the pilot pump 12 and the control valve 14A (the pilot part thereof). That is, the boost proportional solenoid valve 25 is branched from a pilot delivery line 26 connecting between the pilot pump 12 and the operating lever device 15, and is provided on the way of a pilot branch line 27 connected to between the pressure-reduction proportional solenoid valve 23 in the pilot line 24 and the control valve 14A. The boost proportional solenoid valve 25 is configured by a regular closing proportional solenoid valve, for example, and is connected to the main controller 32 (a drive permission control part 44 thereof). The boost proportional solenoid valve 25 reduces the pilot pressure to be supplied to the control valve 14A (a pilot part thereof) based upon a command (drive signal) of the main controller 32.

The pressure sensor 28 is provided between the operating lever device 15 and the pressure-reduction proportional solenoid valve 23 in the pilot line 24. The pressure sensor 28 is connected to the main controller 32 (the vehicle body control part 36, the area limit control part 40 and the drive permission control part 44 thereof). The pressure sensor 28 detects a pilot pressure 37 that is outputted from the operating lever device 15, and outputs a detection signal corresponding to the pilot pressure 37 to the main controller 32. That is, the pressure sensor 28 configures an operating amount measuring section that outputs an operating signal in accordance with an operating amount of each of the operating levers 15A.

The other pressure sensor 29 is provided between a connecting part of the pilot line 24 to the pilot branch line 27 and the control valve 14A (the pilot part thereof). The other pressure sensor 29 is connected to the main controller 32 (the drive permission control part 44 thereof). The other pressure sensor 29 detects a pilot pressure 35 that is supplied to the pilot part of the control valve 14A, and outputs a detection signal corresponding to the pilot pressure 35 to the main controller 32.

The blockade solenoid valve 30 is provided between the pilot pump 12 in the pilot delivery line 26 and the operating lever device 15, more specifically, between a branch part to the pilot branch line 27 and the pilot pump 12. The blockade solenoid valves 30 is configured by, for example, a regular opening solenoid switching valve, and is connected to the main controller 32 (the drive permission control part 44 thereof). The blockade solenoid valve 30 blocks a source pressure 34 of the pilot pressure to be supplied to the operating lever device 15 and the boost proportional solenoid valve 25 from the pilot pump 12, based upon a command of the main controller 32.

The posture sensor 31 is composed of sensors (a sensor group of a plurality of sensors) that detect (measure) the posture of the hydraulic excavator 1. That is, the posture sensor 31 is provided in the machine including the working mechanism 5 and the upper revolving structure 4 to detect (measure) various kinds of state amounts for estimating the posture of the machine. The posture sensor 31 includes, for example, a tilt angle sensor that measures a tilt of the upper revolving structure 4, an angle sensor that detects an angle (for example, revolving angle) of the upper revolving structure 4, a rotational angle sensor for boom that detects a rotational angle of the boom 5A of the working mechanism 5, a rotational angle sensor for arm that detects a rotational angle of the arm 5B of the working mechanism 5 and a rotational angle sensor for bucket that detects a rotational angle of the bucket 5C of the working mechanism 5. Accordingly, the posture sensor 31 configures a posture measuring section that outputs a posture signal (detection signal) in accordance with the posture of the machine.

It should be noted that the rotational angle sensor of the working mechanism 5 may be configured by, for example, a potentiometer, a tilt angle sensor, a cylinder stroke sensor, and/or a combination of them. In addition, the angle sensor of the upper revolving structure 4 may be configured by a sensor that measures a relative angle to the lower traveling structure 2, and besides, may be configured by a sensor that measures an angle on terrestrial coordinates using a global positioning navigation satellite system (GNSS).

Such a posture sensor 31 is connected to the main controller 32 (the area limit control part 40 thereof). The main controller 32 (the area limit control part 40 thereof) is provided with a function of controlling the working mechanism 5 such that the working mechanism 5 does not move beyond a preset space area, that is, an area limit control function of controlling the working mechanism 5 based upon measured data of the posture sensor 31 and a lever operation of an operator (for example, a detection signal of the pressure sensor 28). An application example of the area limit control function may include avoidance of collision of the working mechanism 5 with the cab 9, prevention of excessive excavation in an excavating work, avoidance of collision of an upper side of the machine with facilities in a work site, and the like.

Next, an explanation will be made of a system configuration for realizing the area limit control function of the hydraulic excavator 1.

The driving force of the engine 10 is transmitted to the main pump 11 and the pilot pump 12. The main pump 11 generates pressurized oil 33 for driving (operating) each of the hydraulic actuators 22. The pilot pump 12 generates a source pressure 34 of the pilot pressure for controlling the control valve 14A through the operating lever 15A in the operating lever device 15 by an operator. The control valve 14A controls a delivery amount and a delivery direction of the pressurized oil to the hydraulic actuator 22 in accordance with the pilot pressure 35 (of the control valve 14A-side) determined in accordance with an operating amount of each of the operating levers 15A and the like.

The main controller 32 includes a microcomputer provided with, for example, a memory and a UPU (computing device). The main controller 32 includes the vehicle body control part 36, the area limit control part 40 and the drive permission control part 44. It should be noted that the vehicle body control part 36 is mounted in the main controller 32, but the area limit control part 40 and the drive permission control part 44 respectively may be mounted in the main controller 32 or may be mounted in a controller aside from the main controller 32.

The vehicle body control part 36 controls a rotational speed of the engine 10, a flow amount (delivery amount) of the main pump 11 and the like based upon an operating amount of the operating lever 15A calculated from the measured data 38 of the pilot pressure 37 (in the operating lever 15A-side) measured by each of the pressure sensors 28, a working state (operating state) of the engine 10, a delivery pressure of the main pump 11, a load pressure of each of the hydraulic actuators 22, and the like. Therefore, the vehicle body control part 36 is connected to each of the pressure sensors 28, the engine 10 (the engine controller 10A thereof), the main pump 11 (the regulator 11A thereof) and each of the hydraulic actuators 22 (pressure sensors (not shown) thereof). It should be noted that in some cases the vehicle body control part 36 outputs a requested pressure-reduction pilot pressure 39 to the pilot pressure 35 for controlling distribution of the pressurized oil to each of the hydraulic actuators 22 from the main pump 11. Therefore, the vehicle body control part 36 is connected to the area limit control part 40. The requested pressure-reduction pilot pressure 39 is outputted corresponding to each of the hydraulic actuators 22.

Further, a system for realizing the area limit control function is provided with the pressure-reduction proportional solenoid valve 23, the boost proportional solenoid valve 25, the blockade solenoid valve 30, the pressure sensor 29, the area limit control part 40 and the drive permission control part 44. The pressure-reduction proportional solenoid valve 23 is a solenoid valve (speed-reduction proportional solenoid valve) that reduces the pilot pressure 35 to decelerate or stop the hydraulic actuator 22. The boost proportional solenoid valve 25 is a solenoid valve (speed-increase proportional solenoid valve) that increases the pilot pressure 35 to activate or speed up the hydraulic actuator 22. The blockade solenoid valve 30 is a solenoid valve that blocks the source pressure 34 of the pilot pressure. The pressure sensor 29 measures the pilot pressure 35 for controlling the control valve 14A.

The area limit control part 40 has an input side that is connected to the posture sensor 31, each of the pressure sensors 28 and the vehicle body control part 36 and an output side that is connected to each of the pressure-reduction proportional solenoid valves 23 and the drive permission control part 44. The area limit control part 40 configures a control section (area limit control section) that outputs a drive signal (drive current 42 and requested boost pilot pressure 43) for driving each of the control valves 14A, based upon an operating signal (signal of the pilot pressure 37) in accordance to the operating amount of each of the operating levers 15A and a posture signal (detection signal of a state amount concerning the posture) of the posture sensor 31. That is, the area limit control part 40 estimates a posture of the machine based upon the measured data 41 of the posture sensor 31 in the hydraulic excavator 1, and calculates an operating amount of the operating lever 15A by an operator based upon the measured data 38 of the pilot pressure 37 of each of the pressure sensors 28.

In addition, the area limit control part 40, for preventing the machine from deviating from the preset space area, outputs the drive current 42 of the pressure-reduction proportional solenoid valve 23 in accordance with the posture of the machine, the operation of an operator, the requested pressure-reduction pilot pressure 39 outputted from the vehicle body control part 36 and the like, to decelerate or stop the desired hydraulic actuator 22. Otherwise, the area limit control part 40, for preventing the machine from deviating from the preset space area, outputs a requested boost pilot pressure 43 to the drive permission control part 44 for activating or speeding up the desired hydraulic actuator 22 by driving the boost proportional solenoid valve 25 in accordance with the posture of the machine, the operation of an operator, the requested pressure-reduction pilot pressure 39 and the like. The drive current 42 and the requested boost pilot pressure 43 are outputted corresponding to each of the hydraulic actuators 22.

The drive permission control part (operation permission control part) 44 has an input side that is connected to each of the pressure sensors 28, the area limit control part 40 and each of the other pressure sensors 29 and an output side that is connected to each of the boost proportional solenoid valves 25, the monitor/operating panel device 16 and the blockade solenoid valve 30. The drive permission control part 44 determines presence/absence of an operation of the operating lever 15A by an operator based upon the measured data 38 of the pilot pressure 37, and determines whether or not to permit a drive (operation) of each of the hydraulic actuators 22 according to the operating state. The drive permission control part 44 outputs the drive current 45 of the boost proportional solenoid valve 25 to the boost proportional solenoid valve 25 in response to the requested boost pilot pressure 43 outputted from the area limit control part 40 to the hydraulic actuator 22 the drive of which is permitted. Accordingly, the desired hydraulic actuator 22 is activated or speeded up. The drive current 45 is outputted corresponding to each of the hydraulic actuators 22.

On the other hand, the drive permission control part 44 does not output the drive current 45 to the hydraulic actuator 22 the drive of which is not permitted regardless of a value of the requested boost pilot pressure 43. Accordingly, even when the incorrect requested boost pilot pressure 43 is outputted due to the abnormality of the area limit control part 40, the drive permission control part 44 can prevent the boost proportional solenoid valve 25 in the hydraulic actuator 22 the drive of which is not permitted from being driven. Further, the drive permission control part 44 can prevent permission of drives of all the hydraulic actuators 22 when the operating lever 15A is in a neutral position. As a result, an operator can prevent the drives of all the boost proportional solenoid valves 25 by returning the operating lever 15A back to the neutral position, stopping an inappropriate movement of the hydraulic actuator 22.

In addition, the drive permission control part 44 can output abnormality information 46 that the requested boost pilot pressure 43 is abnormal to the monitor/operating panel device 16 in a case where the requested boost pilot pressure 43 is outputted to the hydraulic actuator 22 the drive of which is not permitted. Thereby, the abnormality can be informed to an operator. In addition, the drive permission control part 44 compares the pilot pressure 35 detected by the other pressure sensor 29 with a boost pilot pressure 51 to be described later, making it possible to determine the abnormality of the pilot pressure 35. In a case where the pilot pressure 35 is determined to be abnormal, the drive permission control part 44 outputs a drive current 47 for driving (closing) the blockade solenoid valve 30 to the blockade solenoid valve 30. Accordingly, the source pressure 34 of the pilot pressure can be blocked to stop the machine.

Next, an explanation will be made of the drive permission control part 44 with reference to FIG. 3 to FIG. 9.

Figure 3:
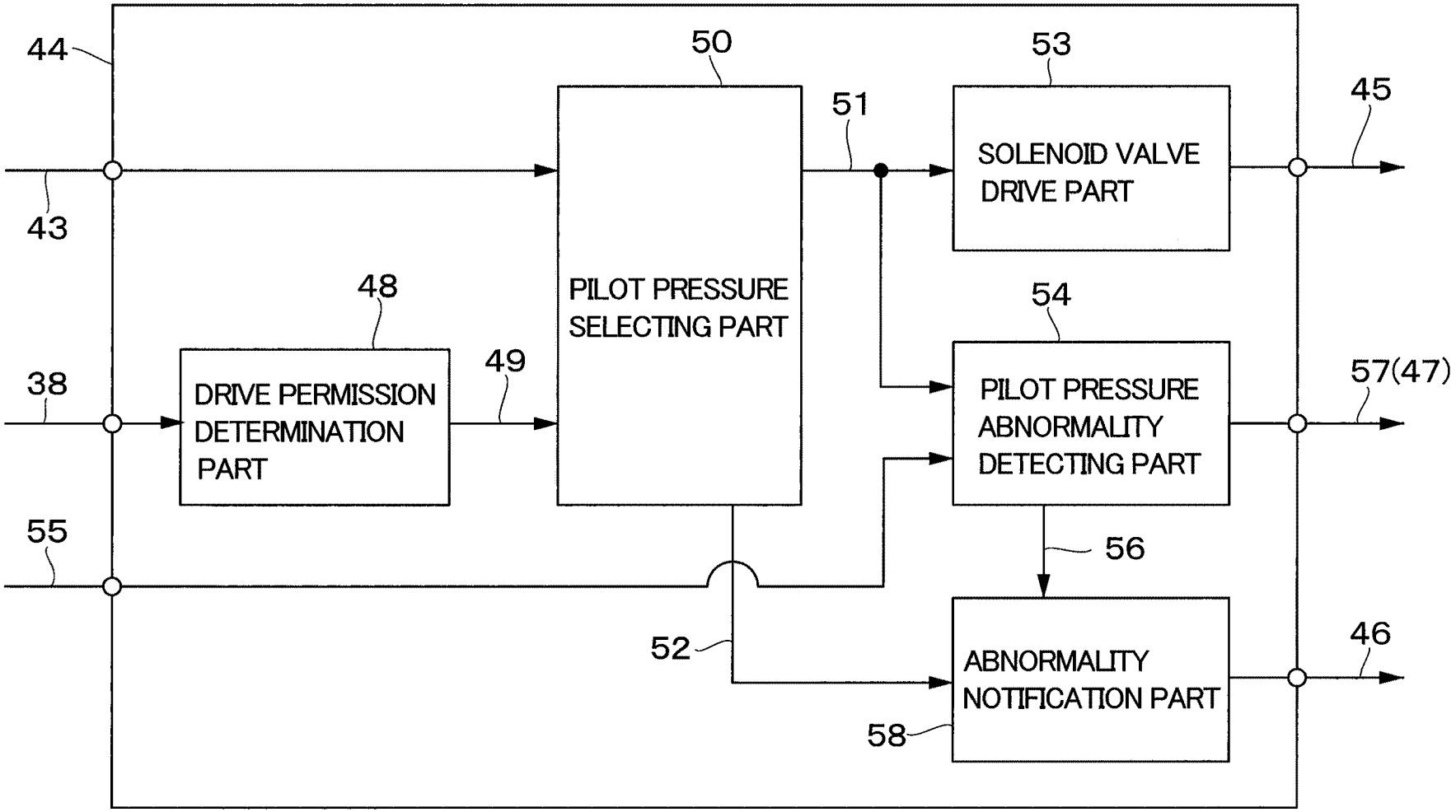
FIG. 3 is a block diagram showing a drive permission control part in FIG. 2.

As shown in FIG. 3, the drive permission control part 44 is provided with a drive permission determination part 48, a pilot pressure selecting part 50, a solenoid valve drive part 53, a pilot pressure abnormality detecting part 54 and an abnormality notification part 58. The drive permission determination part 48 has an input side that is connected to each of the pressure sensors 28 and an output side that is connected to the pilot pressure selecting part 50. The drive permission determination part 48 configures a drive permission determination section that determines whether or not to permit the drive of each of the hydraulic actuators 22 based upon an operating signal in accordance with the operating amount of each of the operating levers 15A and outputs the determination. That is, the drive permission determination part 48 determines the hydraulic actuator 22 the drive of which is permitted according to the operating state of each of the operating levers 15A by an operator based upon the pilot pressure sensor information of each of the pressure sensors 28, that is, the measured data 38 of the pilot pressure 37. In addition, the drive permission determination part 48 outputs a drive permission signal 49 corresponding to the determination result (permission/non-permission of the drive of the hydraulic actuator 22) to the pilot pressure selecting part 50.

The pilot pressure selecting part 50 has an input side that is connected to the area limit control part 40 and the drive permission determination part 48 and an output side that is connected to the solenoid valve drive part 53, the pilot pressure abnormality detecting part 54 and the abnormality notification part 58. The pilot pressure selecting part 50 is formed as a drive signal selecting section configured to select a drive signal (the requested boost pilot pressure 43 from the area limit control part 40) in such a way as to drive the control valve 14A by the drive signal (requested boost pilot pressure 43) to the hydraulic actuator 22 the drive of which is permitted by the drive permission determination part 48 and not to drive the control valve 14A to the hydraulic actuator 22 the drive of which is not permitted.

That is, the pilot pressure selecting part 50 selects the requested boost pilot pressure 43 in response to the drive permission signal 49 outputted from the drive permission determination part 48, that is, the requested boost pilot pressure 43 of the hydraulic actuator 22 the drive of which is permitted as the boost pilot pressure 51, out of the requested boost pilot pressures 43 from the area limit control part 40. In addition, the pilot pressure selecting part 50 outputs the boost pilot pressure 51 to the solenoid valve drive part 53 and the pilot pressure abnormality detecting part 54.

Further, the pilot pressure selecting part 50, when the requested boost pilot pressure 43 of the hydraulic actuator 22 the drive of which is not permitted is not zero, outputs requested-boost pilot pressure abnormality information 52 that the requested boost pilot pressure 43 is abnormal to the abnormality notification part 58. That is, the pilot pressure selecting part 50 is also formed as an abnormality detecting section (requested-boost pilot pressure abnormality detecting section) that detects control abnormality based upon the drive signal (requested boost pilot pressure 43) of each of the hydraulic actuators 22 and the drive permission signal 49 determined in the drive permission determination part 48. It should be noted that the processing in FIG. 10 to be executed in the pilot pressure selecting part 50 will be explained later.

The solenoid valve drive part 53 has an input side that is connected to the pilot pressure selecting part 50 and an output side that is connected to the boost proportional solenoid valve 25. The solenoid valve drive part 53 outputs the drive current 45 of the boost proportional solenoid valve 25 to the boost proportional solenoid valve 25 based upon the boost pilot pressure 51 from the pilot pressure selecting part 50. Thereby, the boost proportional solenoid valve 25 opens in response to the drive current 45 to supply the pilot pressure corresponding to the boost pilot pressure 51 to the pilot part of the control valve 14A in the hydraulic actuator 22 the drive of which is permitted.

The pilot pressure abnormality detecting part 54 has an input side that is connected to the pilot pressure selecting part 50 and each of the other pressure sensors 29 and an output side that is connected to the abnormality notification part 58 and the blockade solenoid valve 30. The pilot pressure abnormality detecting part 54 compares the measured data of the pilot pressure 35 as pilot pressure sensor information 55 of each of the other pressure sensors 29 with the boost pilot pressure 51 from the pilot pressure selecting part 50 to detect the abnormality of the pilot pressure 35. The pilot pressure abnormality detecting part 54 outputs the pilot pressure abnormality information 56 that the pilot pressure 35 is abnormal to the abnormality notification part 58 in a case where the abnormality of the pilot pressure 35 is detected.

Together with it, the pilot pressure abnormality detecting part 54 outputs a pilot pressure blocking request 57 as a command signal (drive current 47) for blocking the pilot pressure (the source pressure 34 thereof) to the blockade solenoid valve 30. That is, the pilot pressure abnormality detecting part 54 is formed as another abnormality detecting section (pilot pressure abnormality detecting section) that detects the control abnormality based upon a drive signal (boost pilot pressure 51) selected in the pilot pressure selecting part 50 and an actual drive signal (pilot pressure 35) to be supplied to the control valve 14A, and a drive signal stopping section that blocks a drive signal (pilot pressure) to the control valve 14A when the abnormality is detected. It should be noted that the processing in FIG. 11 to be executed in the pilot pressure abnormality detecting part 54 will be explained later.

The abnormality notification part 58 has an input side that is connected to the pilot pressure selecting part 50 and the pilot pressure abnormality detecting part 54 and an output side that is connected to the monitor/operating panel device 16. The abnormality notification part 58 is formed as an abnormality notification section configured to notify the abnormality when the control abnormality is detected by the pilot pressure selecting part 50 and/or the pilot pressure abnormality detecting part 54. That is, the abnormality notification part 58 outputs the abnormality information 46 concerning occurrence of the abnormality and corresponding to a content of the abnormality to the monitor/operating panel device 16 based upon the requested-boost pilot pressure abnormality information 52 from the pilot pressure selecting part 50 and/or the pilot pressure abnormality information 56 from the pilot pressure abnormality detecting part 54.

Here, the drive permission determination part 48 can preliminarily set the hydraulic actuator 22 the drive of which is permitted for each lever operation of an operator. FIG. 5 and FIG. 8 are drive permission setting tables 60, 62 that show setting examples of a movement of the hydraulic actuator 22 permitted at each lever operation time in a matrix. The drive permission determination part 48, in a case where one or more of the lever operations are performed, determines whether or not the movement of each of the hydraulic actuators 22 is permitted by any of the lever operations based upon the drive permission setting tables 60, 62. In addition, the drive permission determination part 48 determines the movements of all the hydraulic actuators 22 as non-permission in a case where any of the lever operations is not performed, that is, when the operating lever 15A is in the neutral position, and the drive permission signal 49 corresponding to this determination result is outputted as a drive permission signal En.

Figure 4:
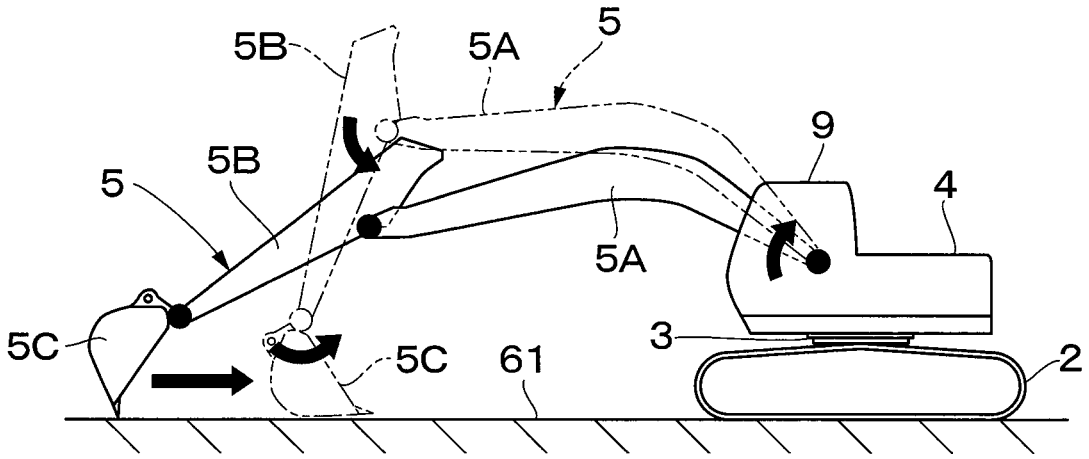
FIG. 4 is a diagram schematically showing an example of a movement of the hydraulic excavator as viewed in the same direction as in FIG. 1.

The setting of the drive permission setting table 60 in FIG. 5 is made to move the boom 5A in a raising direction by the area limit control part 40 at the time of operating the arm 5B or the bucket 5C, such that the bucket 5C does not dig the side deeper than a target surface 61 in an excavating work or a uniform work as shown in FIG. 4. When an operator performs the arm pulling operation and the bucket excavating operation, as shown in FIG. 6, the drive permission determination part 48 permits the boom raising as well in addition to the arm pulling and the bucket excavating. Accordingly, the boom raising movement by the area limit control part 40 is made possible without the boom raising operation by an operator. On the other hand, even when the area limit control part 40 outputs the incorrect requested boost pilot pressure 43 due to malfunction of the area limit control part 40, when an operator returns the operating lever 15A back to the neutral position, the determination results of the drive permission determination part 48 are all made to the non-permission. Thereby, it is possible to stop the inappropriate movement of the hydraulic actuator 22.

Figure 7:
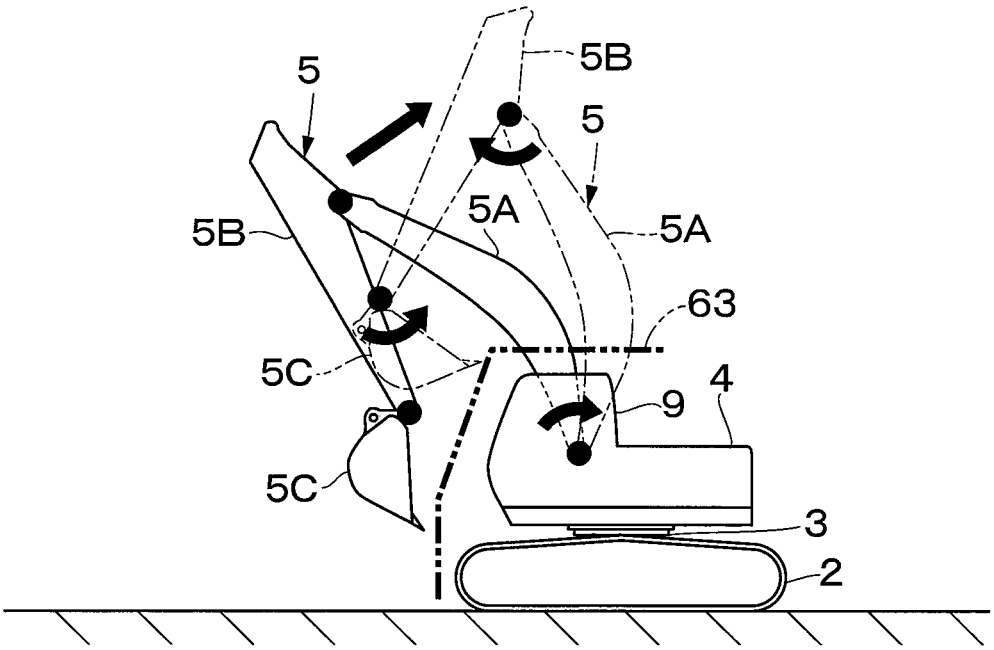
FIG. 7 is a diagram schematically showing another example of the operation of the hydraulic excavator as viewed in the same direction as in FIG. 1.

On the other hand, the setting of the drive permission setting table 62 in FIG. 8, as shown in FIG. 7, is to dispose an interference prevention area 63 in such a manner that the bucket 5C does not collide with the upper revolving structure 4 and the lower traveling structure 2, and moves the arm 5B in a pushing direction by the area limit control part 40 at the time of operating the boom 5A, the arm 5B and the bucket 5C. When an operator performs the boom raising operation and the bucket excavating operation, the drive permission determination part 48, as shown in FIG. 9, permits the arm pulling in addition to the boom raising and the bucket excavating. Thereby, the arm pushing movement by the area limit control part 40 is made possible even without the arm pushing operation by an operator. On the other hand, even when the area limit control part 40 outputs the incorrect requested boost pilot pressure 43 due to malfunction of the area limit control part 40, when an operator returns the operating lever 15A back to the neutral position, the determination results of the drive permission determination part 48 are all made to the non-permission. Therefore, it is possible to stop the inappropriate movement of the hydraulic actuator 22.

Thus, the drive permission determination part 48 is provided with the drive permission setting table 60 as shown in FIG. 5 and/or the drive permission setting table 62 as shown in FIG. 8. The drive permission setting tables 60, 62 each represent a corresponding relation between a lever operation by an operator and a lever operation for permitting a drive in response thereto. In addition, the drive permission setting table 60 in FIG. 5 and/or the drive permission setting table 62 in FIG. 8 are configured as drive permission setting sections configured to set one or a plurality of lever operations for permitting a drive to each of the hydraulic actuators 22. It should be noted that the drive permission setting section is only required to set a corresponding relation between a lever operation by an operator and a lever operation for permitting a drive in response thereto, and is not limited to the tables (matrixes) as shown in FIG. 5 and in FIG. 8. In addition, the drive permission setting tables 60, 62 are not limited to those in FIG. 5 and in FIG. 8, but various kinds of the drive permission setting tables (a corresponding relation between a lever operation by an operator and a lever operation for permitting a drive in response thereto) may be set in response to the limit control of the area limit control part 40.

Figure 10:
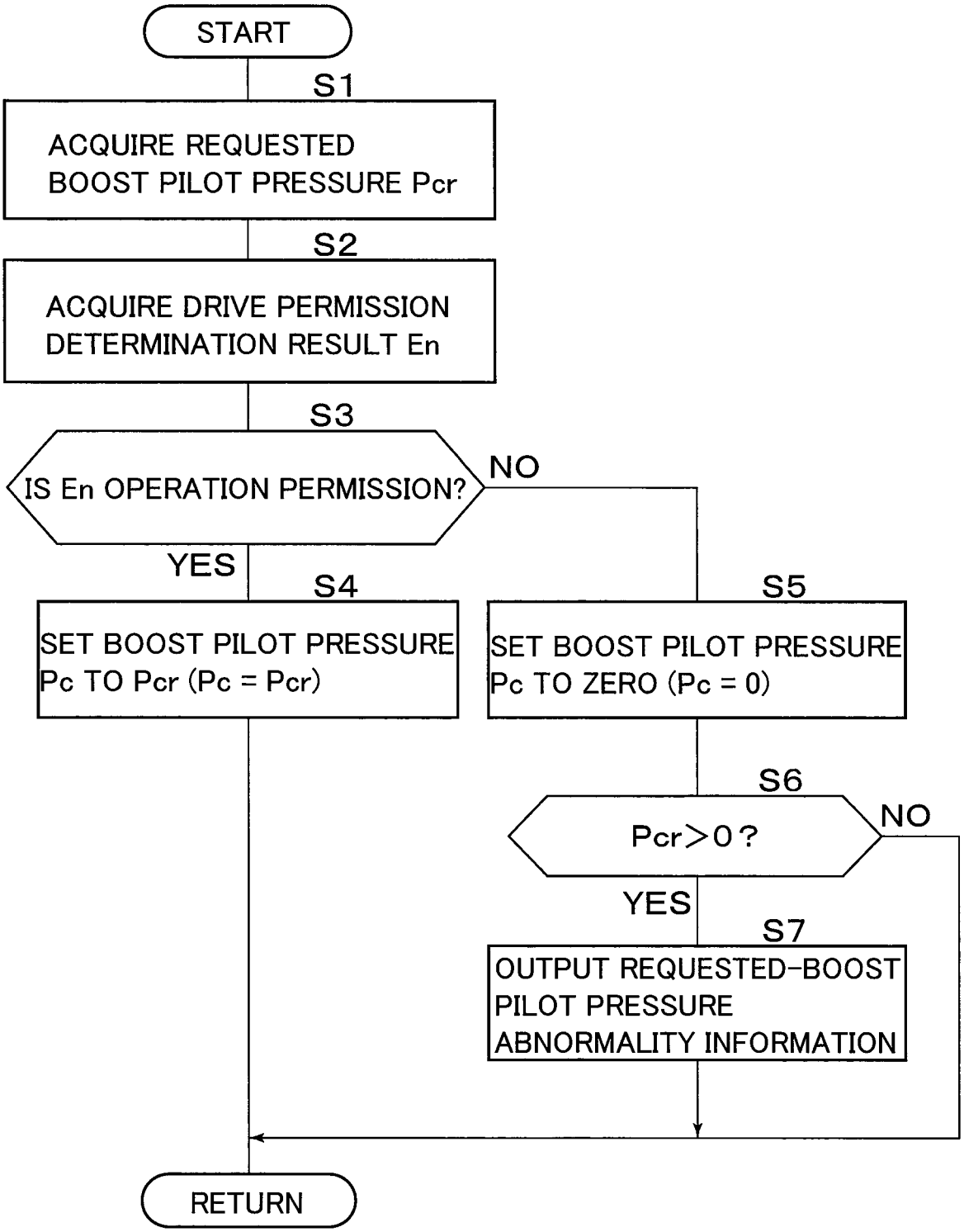
FIG. 10 is a flow chart showing processing to be executed in a pilot pressure selecting part in FIG. 3.

Next, FIG. 10 shows the control processing that is executed in the pilot pressure selecting part 50. The control processing in FIG. 10 is repeatedly executed in a predetermined control cycle during power supply to the main controller 32 (pilot pressure selecting part 50), for example. It should be noted that each step in a flow chart shown in FIG. 10 (and in FIG. 11 and in FIG. 18 to be described later) is shown in a sign of "S" (for example, step 1=S1).

When the control processing of the pilot pressure selecting part 50 starts, at step S1, the pilot pressure selecting part 50 acquires the requested boost pilot pressure 43 outputted from the area limit control part 40, that is, a requested boost pilot pressure Pcr. At a subsequent step S2, the drive permission signal 49 corresponding to the drive permission determination result outputted from the drive permission determination part 48, that is, a drive permission signal En is acquired. At step 3, it is determined whether or not the drive permission signal En is "drive permission".

At S3, in a case where "YES" determination is made, that is, in a case where it is determined that the drive permission signal En is "drive permission", the process goes to S4. At S4, the requested boost pilot pressure Pcr is defined as a boost pilot pressure Pc. That is, the boost pilot pressure 51 is outputted as the boost pilot pressure Pc (=Pcr) to the solenoid valve drive part 53 and the pilot pressure abnormality detecting part 54, and the process returns (the process returns to START, and the processing after S1 is repeated).

On the other hand, at S3, in a case where "NO" determination is made, that is, in a case where it is determined that the drive permission signal En is "drive non-permission", the process goes to S5. At S5, the requested boost pilot pressure Pcr is defined as zero. That is, the boost pilot pressure 51 is outputted as the boost pilot pressure Pc (=0) to the solenoid valve drive part 53 and the pilot pressure abnormality detecting part 54. At subsequent step S6, it is determined whether or not the requested boost pilot pressure Pcr acquired at S1 is a value greater than zero.

In a case where "YES" determination is made at S6, that is, in a case where it is determined that the requested boost pilot pressure Pcr acquired at S1 is the value greater than zero, the process goes to S7. At S7, the requested-boost pilot pressure abnormality information 52 as abnormality information that the requested boost pilot pressure Pcr is abnormal is outputted to the abnormality notification part 58, and the process returns. On the other hand, in a case where at S6 "NO" determination is made, that is, in a case where it is determined that the requested boost pilot pressure Pcr acquired at S1 is not the value greater than zero (Pcr=0), the process returns without through S7. These processes, that is, the processing to be executed in the pilot pressure selecting part 50 is executed to the movement in each of the hydraulic actuators 22.

Figure 11:
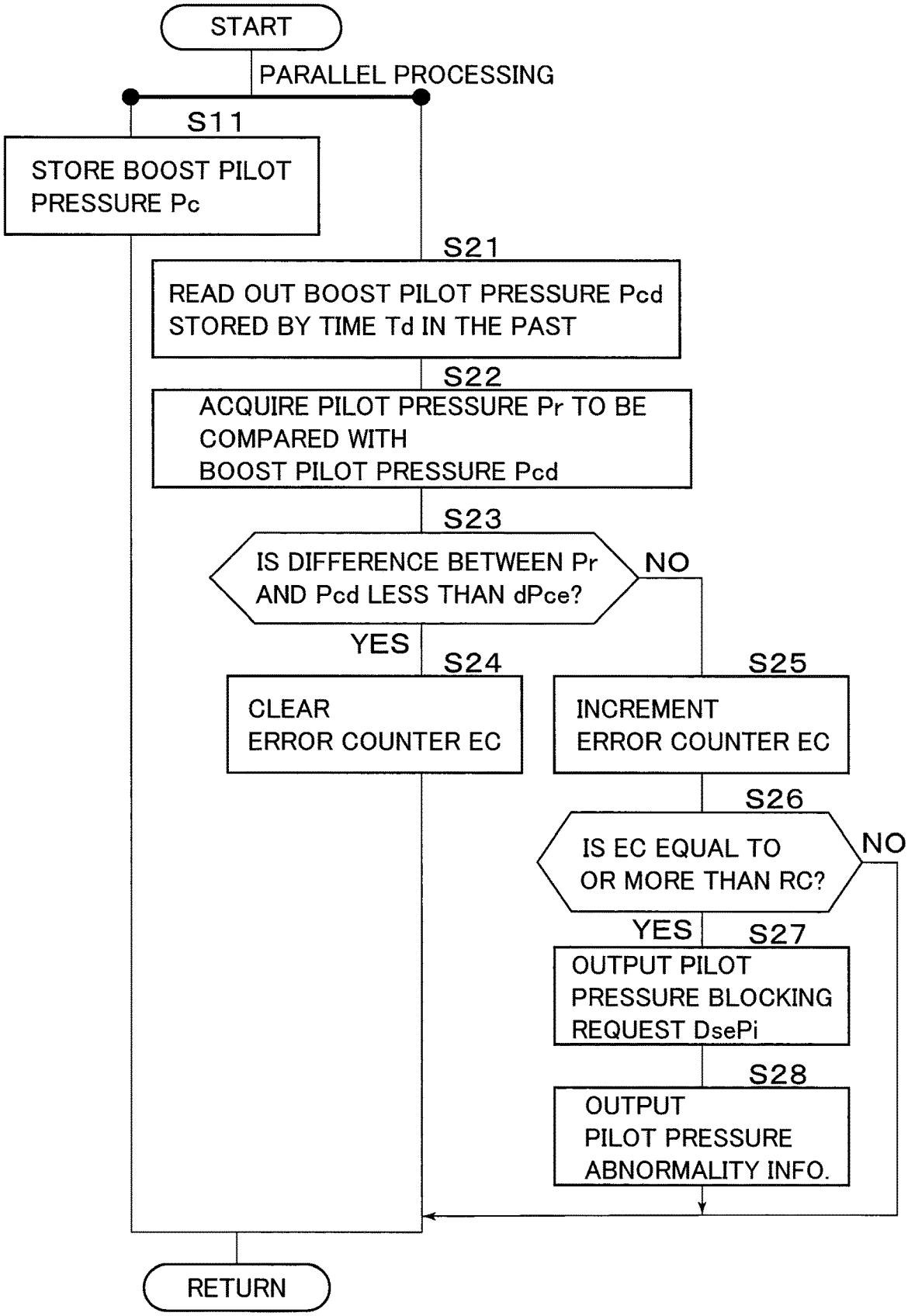
FIG. 11 is a flow chart showing processing to be executed in a pilot pressure abnormality selecting part in FIG. 3.

Next, FIG. 11 shows the control processing that is executed in the pilot pressure abnormality detecting part 54. The control processing as well in FIG. 11, as similar to the processing in FIG. 10, is repeatedly executed in a predetermined control cycle, for example, during power supply to the main controller 32 (pilot pressure abnormality detecting part 54).

When the control processing of the pilot pressure abnormality detecting part 54 starts, at S11, the pilot pressure abnormality detecting part 54 stores the boost pilot pressure 51 outputted from the pilot pressure selecting part 50, that is, the boost pilot pressure Pc, and the process returns (the process is back to START through RETURN, and the processing at S11 is repeated). In addition, the processing after S21 is also executed in parallel to the processing at S11.

At S21, a boost pilot pressure Pcd stored prior to the present point by time Td is read out. It should be noted that time Td is a sum of a time from a point where the boost pilot pressure Pc is determined to a point where the pilot pressure 35 in accordance therewith is generated and a time from a point where the generated pilot pressure 35 is measured by the other pressure sensor 29 to a point where the pilot pressure abnormality detecting part 54 acquires the pilot pressure Pr as the measured result (pilot pressure sensor information 55). That is, the boost pilot pressure Pcd is equivalent to the past boost pilot pressure Pc corresponding to the pilot pressure Pr acquired by the pilot pressure abnormality detecting part 54.

At S22 subsequent to S21, the pilot pressure abnormality detecting part 54 acquires an actual pilot pressure Pr from the other pressure sensor 29, which is compared with the boost pilot pressure Pcd read out at S1. That is, at subsequent S23, it is determined whether or not a difference between the actual pilot pressure Pr and the boost pilot pressure Pcd is less than dPce as a predetermined abnormality determination difference threshold value. At S23 in a case where "YES" determination is made, that is, in a case where it is determined that the difference between the actual pilot pressure Pr and the boost pilot pressure Pcd is less than dPce, the pilot pressure 35 can be determined to be correct. Therefore, the process goes to S24, wherein an error counter EC is cleared to return the process (the process is back to START through RETURN, and the processing after S21 is repeated). It should be noted that the threshold value dPce can be set as a value in more than which a high possibility that the abnormality of the pilot pressure 35 is generated can be determined, for example. The threshold value dPce is in advance found by, for example, experiments, calculations, simulations and the like to make it possible to perform the determination of the abnormality with accuracy.

On the other hand, at S23, in a case where "NO" determination is made, that is, in a case where it is determined that the difference between the actual pilot pressure Pr and the boost pilot pressure Pcd is equal to or more than dPce, the pilot pressure 35 can be determined to be incorrect. Therefore, the process goes to S25, wherein an error counter is incremented. In addition, at subsequent S26 it is determined whether or not the error counter EC is equal to or more than RC as a predetermined threshold value to the times of abnormality determinations.

At S26, in a case where "YES" determination is made, that is, in a case where it is determined that the error counter EC is equal to or more than RC, the process goes to S27, wherein a pilot pressure blocking request 57 as a command signal for blocking the source pressure 34 of the pilot pressure, that is, a pilot pressure blocking request DesPi is outputted to the blockade solenoid valve 30. Thereby, the blockade solenoid valve 30 is made to a closed position (blocked position) to stop the machine. At subsequent S28, the pilot pressure abnormality information 56 that the pilot pressure 35 is abnormal is outputted to the abnormality notification part 58. Accordingly, the abnormality notification part 58 outputs the abnormality information 46 concerning the occurrence of the abnormality and corresponding to the content of the abnormality to the monitor/operating panel device 16, making it possible to inform an operator of the abnormality. When at S28, the pilot pressure abnormality information 56 is outputted, the process returns. It should be noted that the threshold value RC may be set as a value in more than which it can be determined that the machine is preferably stopped, for example. The threshold value RC is in advance determined by, for example, experiments, calculations, simulations and the like to make it possible to appropriately perform the stop of the machine.

On the other hand, at S26, in a case where "NO" determination is made, that is, in a case where it is determined that the error counter EC is less than RC, the process returns without through S27 and S28. These processes, that is, the processing to be executed in the pilot pressure abnormality detecting part 54 is executed to the movement in each of the hydraulic actuators 22. That is, the pilot pressure blocking request DesPi and the blockade solenoid valve 30 may be provided in each of the hydraulic actuators 22, respectively. In this case, it is possible to stop only the movement of the hydraulic actuator 22 corresponding to the abnormality. On the other hand, the blockade solenoid valve 30 may be not provided and S27 may be omitted. In this case, it is possible to stop the machine by performing a key-off operation by an operator based upon the notification of the abnormality by the monitor/operating panel device 16.

The hydraulic excavator 1 according to the present embodiment has the aforementioned configuration, and next, an explanation will be made of the movement.

When an operator having boarded on the cab 9 activates the engine 10, the main pump 11 and the pilot pump 12 are driven by the engine 10. Accordingly, the pressurized oil delivered from the main pump 11 is supplied to each of the hydraulic actuators 22 (that is, the left and right traveling hydraulic motors 2E, the revolving hydraulic motor 3A, the boom cylinder 5D, the arm cylinder 5E and the bucket cylinder 5F in the working mechanism 5) in response to the operation of the operating lever 15A in the operating lever device 15 provided in the inside of the cab 9 (for example, a lever operation of the operating lever for work, a lever operation of the operating lever/pedal for travel, and a pedal operation). As a result, the hydraulic excavator 1 can perform the traveling movement by the lower traveling structure 2, the revolving movement by the upper revolving structure 4, the excavating movement by the working mechanism 5, and the like.

Figure 12:
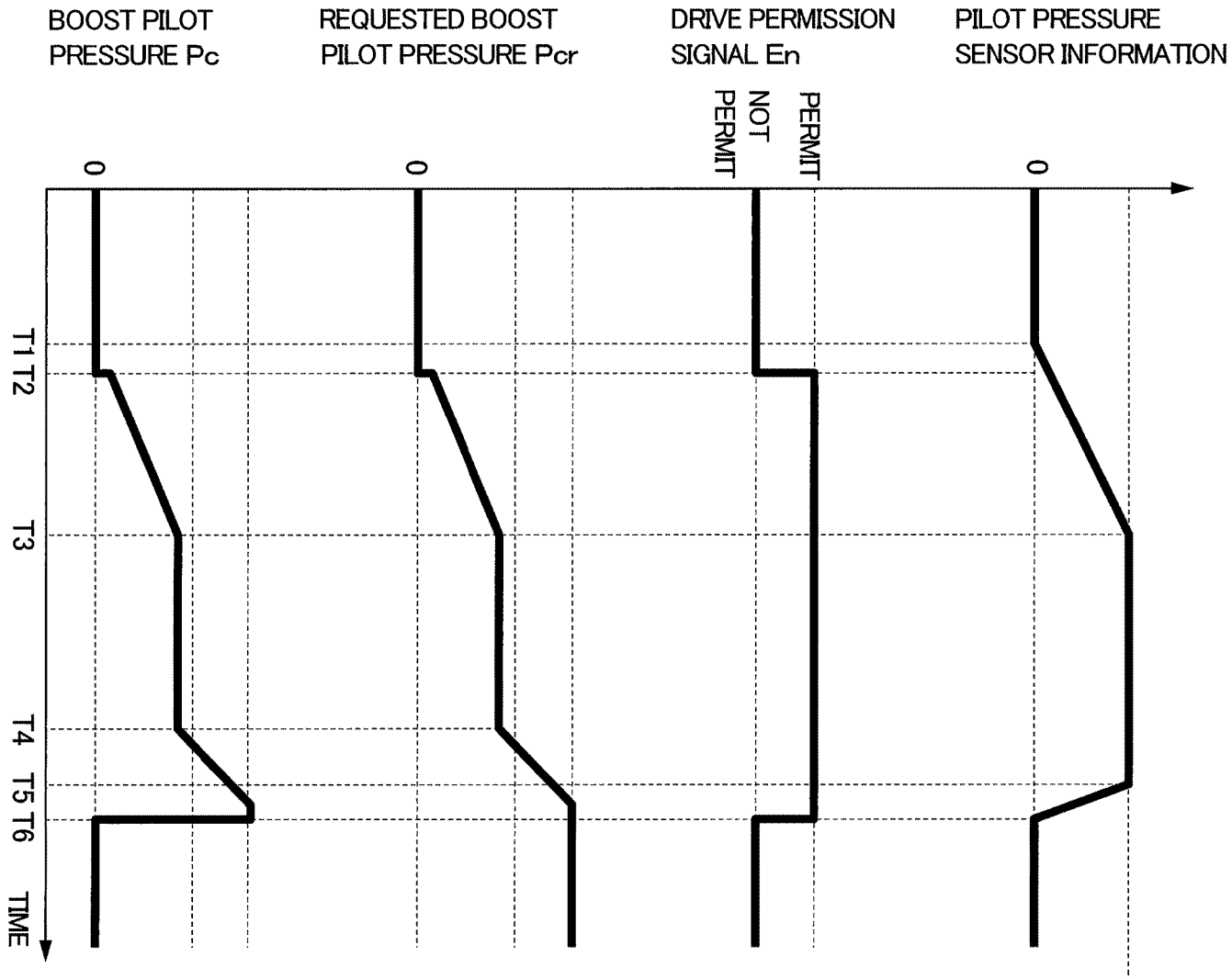
FIG. 12 is a characteristic line diagram showing an example of a change with time in pilot pressure sensor information, drive permission signal, requested boost pilot pressure and boost pilot pressure.
Figure 13:
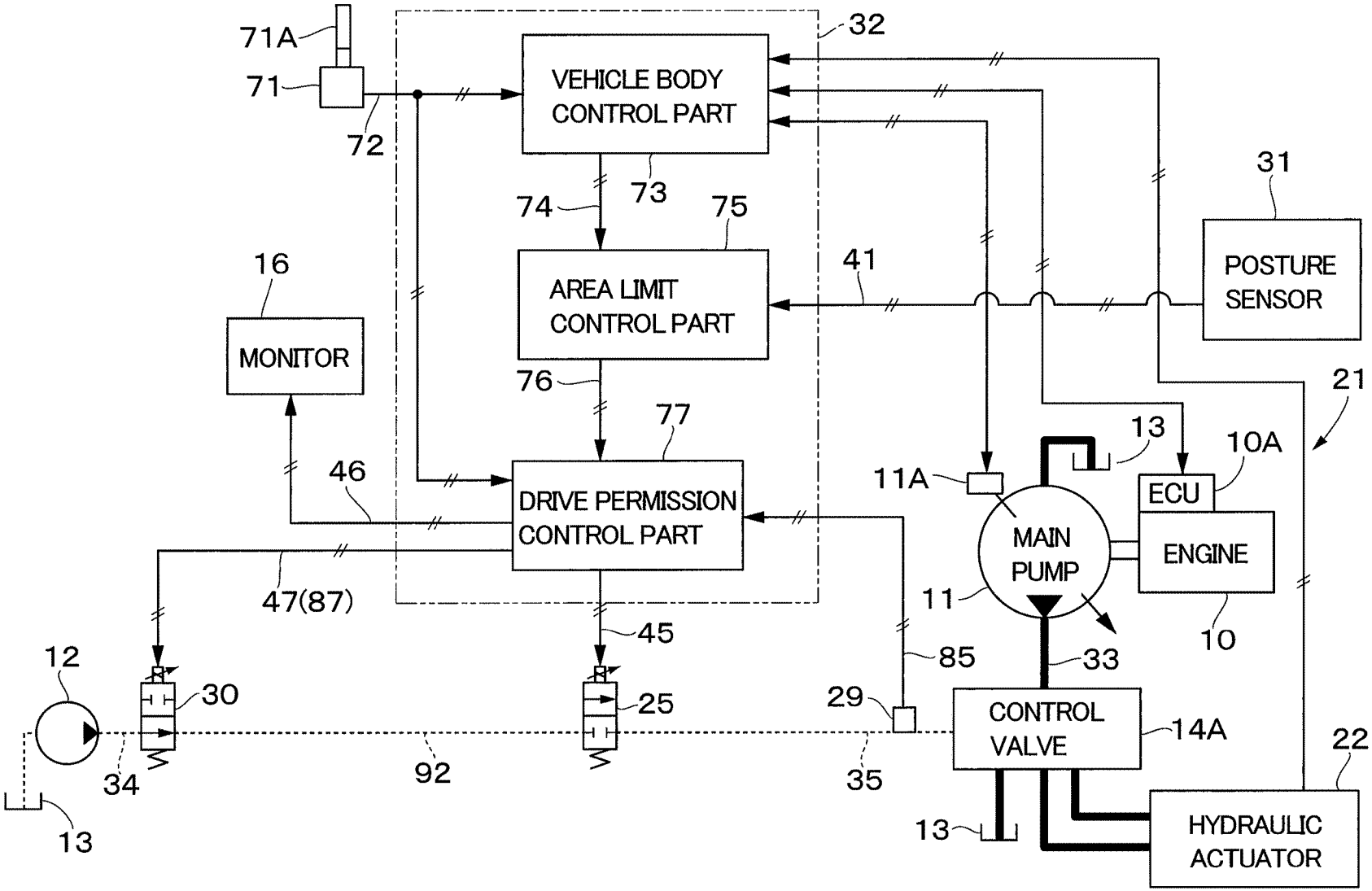
FIG. 13 is a block diagram schematically showing a hydraulic system (hydraulic circuit) and an electrical system (control circuit) of a hydraulic excavator according to a second embodiment.

Here, FIG. 12 shows a basic movement by the drive permission control part 44 when the operating lever 15A is operated. At a point of T1, an operation of the operating lever 15A by an operator is started and a pilot pressure 37 is generated by this operation. At a point of T2, the drive permission determination part 48 of the drive permission control part 44 outputs the drive permission signal En of each of the hydraulic actuators 22 in accordance with the operating state of each of the operating levers 15A by an operator, based upon the pilot pressure sensor information (the measured data 38 of the pilot pressure 37 thereof). In addition, since the drive permission signal En is "drive permission" from a point of T2 to a point of T6, the pilot pressure selecting part 50 of the drive permission control part 44 outputs the requested boost pilot pressure Pcr from the area limit control part 40 as the boost pilot pressure Pc. At this time, the solenoid valve drive part 53 of the drive permission control part 44 outputs the drive current 45 to the boost proportional solenoid valve 25 based upon the boost pilot pressure Pc. Accordingly, the movement of the hydraulic actuator by the area limit control part 40 is made possible.

On the other hand, when the incorrect requested boost pilot pressure Pcr due to the malfunction of the area limit control part 40 is outputted from a point of T4, for example, an operator having had uncomfortable feelings to the movement due to this malfunction starts to return all the operating levers 15A back to the neutral position at a point of T5. In this case, at a point of T6, the drive permission determination part 48 of the drive permission control part 44 makes the drive permission signal En of all the hydraulic actuators 22 "drive non-permission". As a result, since the pilot pressure selecting part 50 of the drive permission control part 44 makes all of the boost pilot pressures Pc "zero", the drive of the boost proportional solenoid valve 25 by the solenoid valve drive part 53 of the drive permission control part 44 stops. Thereby, it is possible to stop the inappropriate movement of the hydraulic actuator 22.

Thus, in the first embodiment, the drive permission determination part 48 determines whether or not to permit the drive of each of the hydraulic actuators 22 in response to an operating state of the operating lever 15A. In addition, in a case where the drive is permitted, the pilot pressure selecting part 50 drives the control valve 14A in response to a drive signal (requested boost pilot pressure 43) outputted from the area limit control part 40. On the other hand, in a case where the drive is not permitted, even when the drive signal (requested boost pilot pressure 43) is outputted from the area limit control part 40, the pilot pressure selecting part 50 selects a drive signal not to drive the control valve 14A. Therefore, when an operator operates the operating lever 15A, it is possible to permit not only the drive of the hydraulic actuator 22 corresponding to the operating lever 15A but also the drive of the hydraulic actuator 22 required for moving the machine such that the working mechanism 5 does not deviate from the predetermined spacious area. Together with it, when an operator sets the operating lever 15A to a neutral position, even when the area limit control part 40 outputs the drive signal (requested boost pilot pressure 43) by mistake, since the drive of the hydraulic actuator 22 is not permitted, it is possible to stop the machine.

In the first embodiment, it is possible to optionally set one or a plurality of lever operations for permitting the drive to each of the hydraulic actuators 22 by the drive permission setting table 60 in FIG. 5 and the drive permission setting table 62 in FIG. 8 corresponding to the drive permission setting section. Therefore, it is possible to set the drive permission suitable for the configuration of the working mechanism 5 and the drive permission suitable for the spacious area for preventing deviation of the working mechanism 5.

The first embodiment is provided with the pilot pressure abnormality detecting part 54 and the abnormality notification part 58 as the requested-boost pilot pressure abnormality detecting section. Therefore, it is possible to perform detection and notification of the control abnormality based upon the drive signal (requested boost pilot pressure 43) of each of the hydraulic actuators 22 and the drive permission signal 49 outputted by the drive permission determination part 48. Accordingly, it is possible to encourage an operator to repair the machine.

Next, FIG. 13 to FIG. 19 show a second embodiment of the present invention. The second embodiment is characterized in that an operating lever device is configured of an electrical lever device and a pilot pressure upper limit determination part is provided. It should be noted that in the second embodiment, components identical to those in the aforementioned first embodiment are referred to as identical reference numerals, and the explanation is omitted.

A plurality of operating lever devices 71 each are configured as an electrical operating lever device, and have an operating lever 71A to be operated by an operator. Here, the operating lever device 71 is configured as an operating amount measuring section that outputs an operating signal (lever operating amount 72) in accordance with an operating amount of each of the operating levers 71A. The operating lever device 71 has an output side that is connected to a vehicle body control part 73 and a drive permission control part 77 in the main controller 32. When an operator performs a manual tilt operation (lever operation) of the operating lever 71A in the operating lever device 71, an electrical signal (operating signal) corresponding to the lever operating amount 72 is outputted to the vehicle body control part 73 and the drive permission control part 77 in the main controller 32 from the operating lever device 71.

It should be noted that, associated with configuring the operating lever device 71 as the electrical operating lever device, the blockade solenoid valve 30, the proportional solenoid valve 25 and the other pressure sensor 29 are provided in order from the pilot pump 12-side on the way of a pilot line 92 connecting between the pilot pump 12 and the control valve 14A.

The vehicle body control part 73 controls a rotational speed of the engine 10, a flow amount (delivery amount) of the main pump 11 and the like based upon the lever operating amount 72 of the operating lever 71A, a working state (operating state) of the engine 10, a delivery pressure of the main pump 11, a load pressure of each of the hydraulic actuators 22 and the like. Therefore, the vehicle body control part 73 is connected to the operating lever device 71, the engine 10, the main pump 11 and each of the hydraulic actuators 22. In addition, an output side of the vehicle body control part 73 is connected to an area limit control part 75. The vehicle body control part 73 outputs a target pilot pressure 74 corresponding to the pilot pressure 35 for moving each of the hydraulic actuators 22 to the area limit control part 75. The target pilot pressure 74 is outputted corresponding to each of the hydraulic actuators 22.

The area limit control part 75 has an input side that is connected to the posture sensor 31 and the vehicle body control part 73 and an output side that is connected to the drive permission control part 77. The area limit control part 75, together with the vehicle body control part 73, is configured as a control section (area limit control section) that outputs a drive signal (requested pilot pressure 76) for driving each of the control valves 14A based upon an operating signal (lever operating amount 72) in accordance with the operating amount of each of the operating levers 71A and a posture signal (detection signal of a state amount concerning the posture) of the posture sensor 31. That is, the area limit control part 75 estimates the posture of the machine based upon the measured data 41 of the posture sensor 31 in the hydraulic excavator 1, and predicts a change in the posture of the machine based upon the target pilot pressure 74 outputted from the vehicle body control part 73.

In addition, in a case where there is no possibility that the machine deviates from the predetermined space area, the area limit control part 75 outputs the target pilot pressure 74 to the drive permission control part 77 as the requested pilot pressure 76. On the other hand, in a case where there is a possibility that the machine deviates from the predetermined space area, the area limit control part 75 adjusts the target pilot pressure 74 to prevent the deviation, and the adjusted target pilot pressure 74 is outputted to the drive permission control part 77 as the requested pilot pressure 76. The requested pilot pressure 76 is outputted corresponding to each of the hydraulic actuators 22.

The drive permission control part (operation permission control part) 77 has an input side that is connected to the operating lever device 71, the area limit control part 75 and each of the other pressure sensors 29 and an output side that is connected to each of the proportional solenoid valves 25, the monitor/operating panel device 16 and the blockade solenoid valve 30. The drive permission control part 77 recognizes an operating amount of each of the operating levers 71A by an operator based upon the lever operating amount 72 of the operating lever 71A, and determines a pilot pressure upper limit value as an upper limit value of the pilot pressure 35 for moving each of the hydraulic actuators 22 in accordance with the lever operating amount 72. In addition, in a case where the requested pilot pressure 76 in response to the movement of each of the hydraulic actuators 22 is equal to or less than the pilot pressure upper limit value, the drive permission control part 77 outputs the drive current 45 for driving the proportional solenoid valve 25 in accordance with the requested pilot pressure 76 to the proportional solenoid valve 25. On the other hand, in a case where the requested pilot pressure 76 is higher than the pilot pressure upper limit value, the drive permission control part 77 outputs the drive current 45 for driving the proportional solenoid valve 25 in accordance with the pilot pressure upper limit value to the proportional solenoid valve 25.

Accordingly, even when the incorrect requested pilot pressure 76 is outputted from the area limit control part 75 due to the abnormality of the vehicle body control part 73 or the area limit control part 75, the movement of each of the hydraulic actuators 22 is controlled to a speed in accordance with the pilot pressure upper limit value determined in accordance with the lever operating amount 72 of an operator. Further, when the operating lever 71A is in a neutral position, the drive permission control part 77 can make the pilot pressure upper limit value zero in such a manner as not to permit the drives of all the hydraulic actuators 22. Accordingly, when an operator returns the operating lever 71A back to the neutral position, the pilot pressure upper limit value becomes zero, thus making it possible to stop an inappropriate movement of the hydraulic actuator 22.

Further, when a requested pilot pressure 76 higher than the pilot pressure upper limit value is outputted from the area limit control part 75, the drive permission control part 77 can output the abnormality information 46 that the requested pilot pressure 76 is abnormal to the monitor/operating panel device 16. Accordingly, the abnormality can be notified to an operator. In addition, the drive permission control part 77 can determine the abnormality of the pilot pressure 35 by comparing the pilot pressure 35 detected by the other pressure sensor 29 with a pilot pressure 81 to be described later. In a case where the pilot pressure 35 is determined to be abnormal, the drive permission control part 77 can output the drive current 47 for driving (closing) the blockade solenoid valve 30 to the blockade solenoid valve 30. Accordingly, the source pressure 34 of the pilot pressure is blocked, thus making it possible to stop the machine.

Next, an explanation will be made of the drive permission control part 77 with reference to FIG. 14 to FIG. 17.

Figure 14:
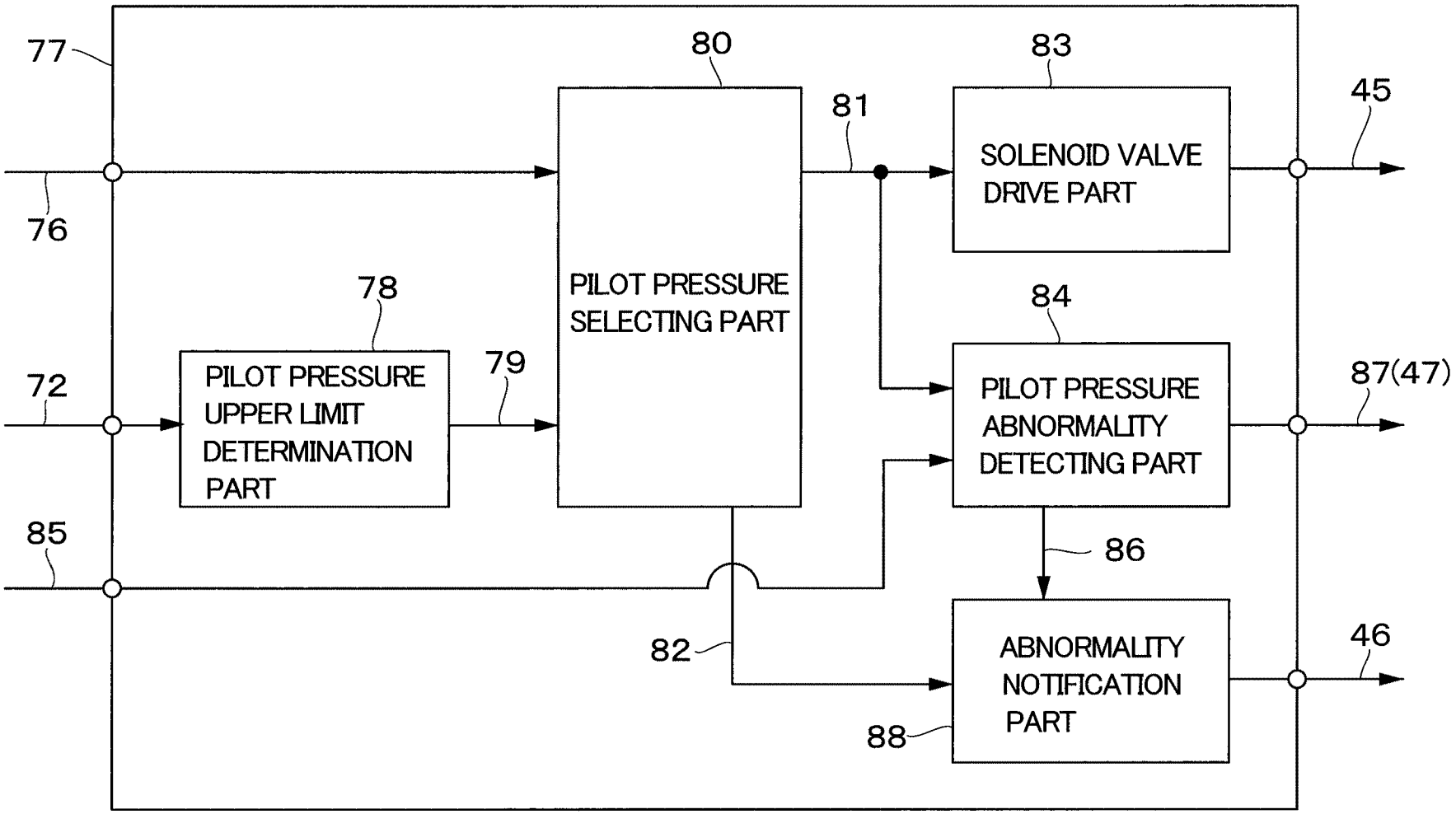
FIG. 14 is a block diagram showing a drive permission control part in FIG. 13.

As shown in FIG. 14, the drive permission control part 77 is provided with a pilot pressure upper limit determination part 78, a pilot pressure selecting part 80, a solenoid valve drive part 83, a pilot pressure abnormality detecting part 84 and an abnormality notification part 88. The pilot pressure upper limit determination part 78 has an input side that is connected to the operating lever device 71 and an output side that is connected to the pilot pressure selecting part 80. The pilot pressure upper limit determination part 78 is configured as a drive signal upper limit determination section configured to determine and output an upper limit value (pilot pressure upper limit value) of a drive signal (requested pilot pressure 76) for driving the control valve 14A of each of the hydraulic actuators 22 based upon an operating signal (lever operating amount 72) in accordance with the operating amount of each of the operating levers 71A. That is, the pilot pressure upper limit determination part 78 determines a pilot pressure upper limit value of each of the hydraulic actuators 22 according to the operating state of each of the operating levers 71A by an operator based upon the lever operating amount 72. In addition, the pilot pressure upper limit determination part 78 outputs the pilot pressure upper limit value 79 of each of the hydraulic actuators 22 to the pilot pressure selecting part 50.

The pilot pressure selecting part 80 has an input side that is connected to the area limit control part 75 and the pilot pressure upper limit determination part 78 and an output side that is connected to the solenoid valve drive part 83, the pilot pressure abnormality detecting part 84 and the abnormality notification part 88. The pilot pressure selecting part 80 is configured as a drive signal selecting section configured to select a drive signal (requested pilot pressure 76) in such a way as to drive the control valve 14A by the drive signal (requested pilot pressure 76) to the hydraulic actuator 22 the drive signal (requested pilot pressure 76 from the area limit control part 75) of which is equal to or less than the pilot pressure upper limit value 79 determined in the pilot pressure upper limit determination part 78, and in such a way as to drive the control valve 14A by the pilot pressure upper limit value 79 to the hydraulic actuator 22 the drive signal (requested pilot pressure 76) of which is beyond the pilot pressure upper limit value 79 determined in the pilot pressure upper limit determination part 78.

That is, the pilot pressure selecting part 80 selects any of the requested pilot pressure 76 and the pilot pressure upper limit value 79 of each of the hydraulic actuators 22 as the pilot pressure 81 in accordance with the pilot pressure upper limit value 79. In addition, the pilot pressure selecting part 80 outputs the pilot pressure 81 to the solenoid valve drive part 83 and the pilot pressure abnormality detecting part 84.

Further, the pilot pressure selecting part 80, when the requested pilot pressure 76 is beyond the pilot pressure upper limit value 79, outputs requested-pilot pressure abnormality information 82 that the requested pilot pressure 76 is abnormal to the abnormality notification part 88. That is, the pilot pressure selecting part 80 is configured as an abnormality detecting section (requested-pilot pressure abnormality detecting section) configured to detect control abnormality based upon the drive signal (requested pilot pressure 76) of each of the hydraulic actuators 22 and the upper limit value (pilot pressure upper limit value 79) of the drive signal determined in the pilot pressure upper limit determination part 78. It should be noted that the processing in FIG. 18 to be executed in the pilot pressure selecting part 80 will be explained later.

The solenoid valve drive part 83 has an input side that is connected to the pilot pressure selecting part 80 and an output side that is connected to the proportional solenoid valve 25. The solenoid valve drive part 83 outputs the drive current 45 of the proportional solenoid valve 25 to the boost proportional solenoid valve 25 based upon the pilot pressure 81 from the pilot pressure selecting part 80. Thereby, the proportional solenoid valve 25 opens in response to the drive current 45 to supply the pilot pressure 35 corresponding to the pilot pressure 81 to the pilot part of the control valve 14A.

The pilot pressure abnormality detecting part 84 has an input side that is connected to the pilot pressure selecting part 80 and each of the other pressure sensors 29 and an output side that is connected to the abnormality notification part 88 and the blockade solenoid valve 30. The pilot pressure abnormality detecting part 84 compares the measured data of the pilot pressure 35 as pilot pressure sensor information 85 of each of the other pressure sensors 29 with the pilot pressure 81 from the pilot pressure selecting part 80 to detect the abnormality of the pilot pressure 35. The pilot pressure abnormality detecting part 84 outputs pilot pressure abnormality information 86 that the pilot pressure 35 is abnormal to the abnormality notification part 88 in a case where the abnormality of the pilot pressure 35 is detected.

Together with it, the pilot pressure abnormality detecting part 84 outputs a pilot pressure blocking request 87 as a command signal for blocking the pilot pressure (source pressure 34 thereof) to the blockade solenoid valve 30. That is, the pilot pressure abnormality detecting part 84 is configured as another abnormality detecting section (pilot pressure abnormality detecting section) configured to detect the control abnormality based upon a drive signal (pilot pressure 81) selected in the pilot pressure selecting part 80 and an actual drive signal (pilot pressure 35) supplied to the control valve 14A, and as a drive signal stopping section configured to block a drive signal (pilot pressure) to the control valve 14A at the time of detecting the abnormality. It should be noted that the processing executed in the pilot pressure abnormality detecting part 84 is similar to the processing in FIG. 11 executed in the pilot pressure abnormality detecting part 54 in the first embodiment, other than a point where "boost pilot pressure Pc" is "pilot pressure Pc".

The abnormality notification part 88 has an input side that is connected to the pilot pressure selecting part 80 and the pilot pressure abnormality detecting part 84 and an output side that is connected to the monitor/operating panel device 16. The abnormality notification part 88, when the control abnormality is detected by the pilot pressure selecting part 80 and/or the pilot pressure abnormality detecting part 84, is configured as an abnormality notification section configured to notify the abnormality. That is, the abnormality notification part 88 outputs the abnormality information 46 concerning the occurrence of the abnormality and corresponding to the content of the abnormality to the monitor/operating panel device 16 based upon the requested-pilot pressure abnormality information 82 from the pilot pressure selecting part 80 and/or the pilot pressure abnormality information 86 from the pilot pressure abnormality detecting part 84.

Figure 17:
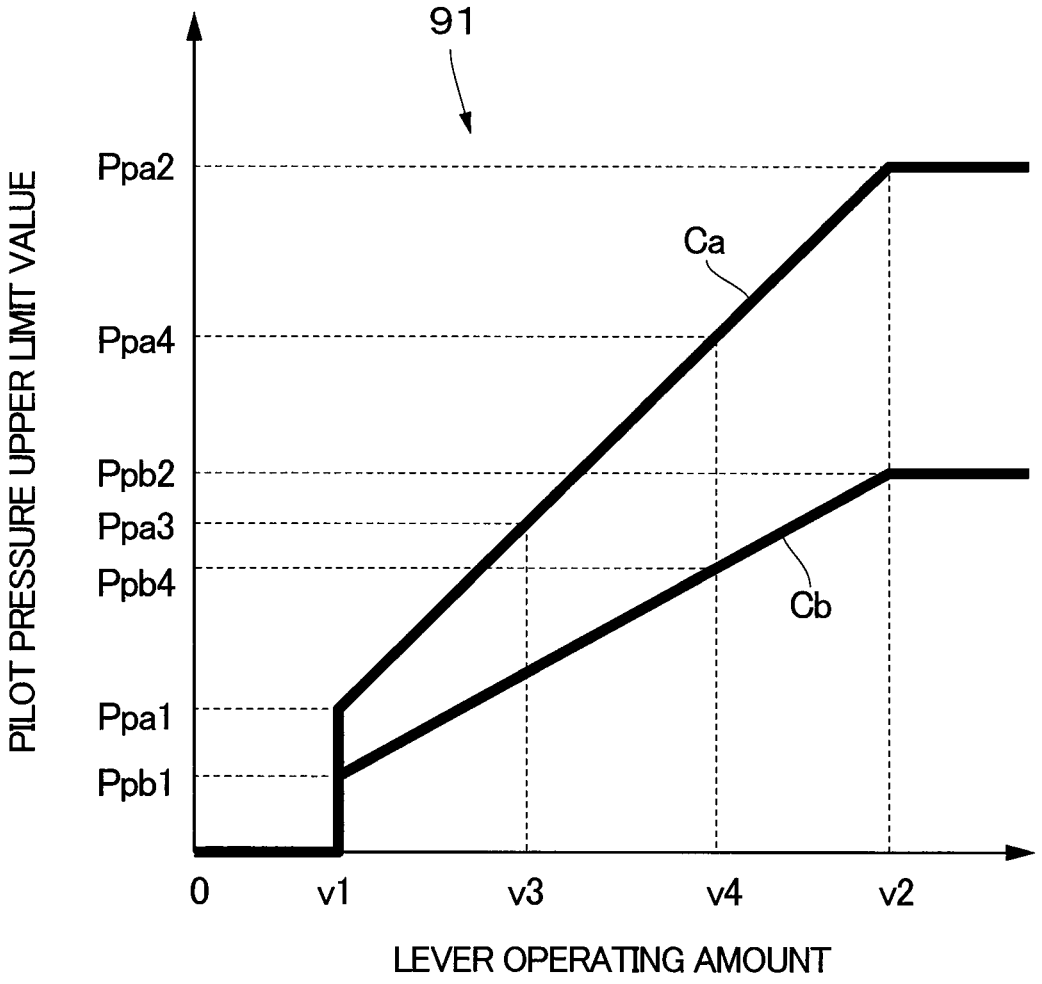
FIG. 17 is a characteristic line diagram showing a relation between a lever operating amount and a pilot pressure upper limit value.

Here, the pilot pressure upper limit determination part 78 can preliminarily set a pilot pressure upper limit value for permitting the movement of each of the hydraulic actuators 22 for each lever operation of an operator. FIG. 15 is a pilot pressure upper limit value setting table 90 that shows an example of a pilot pressure upper limit value for permitting the movement of each of the hydraulic actuators 22 for each lever operation in a matrix. "0" in FIG. 15 indicates that the pilot pressure upper limit value is 0, which means not to move the hydraulic actuator 22. "Ca" and "Cb" in FIG. 15, as shown in FIG. 17, indicate that an upper limit value of the pilot pressure of each varies in accordance with the lever operating amount. As shown in FIG. 17, both "Ca" and "Cb"

are in a dead zone when the lever operating amount is in a range of 0 to v1. When the lever operating amount is in a range of v1 to v2, the pilot pressure upper limit value increases (for example, increases proportionally) with an increase of the lever operating amount in both "Ca" and "Cb". In addition, in v2, the maximum value of the pilot pressure upper limit value, that is, "Ca" reaches Ppa2, and "Cb" reaches Ppb2.

The pilot pressure upper limit determination part 78 outputs the greatest value out of the pilot pressure upper limit values in response to the lever operation for each movement of each of the hydraulic actuators 22 as the pilot pressure upper limit value 79, based upon the pilot pressure upper limit setting table 90 in a case where one or more of the lever operations are performed.

When an operator performs the arm pulling operation and the bucket excavating operation, as shown in FIG. 16 the pilot pressure upper limit determination part 78 determines the pilot pressure upper limit value 79 of each of the hydraulic actuators 22 in accordance with the lever operating amount of each of the arm pulling and the bucket excavating. Specifically, when the arm pulling operating amount is indicated at v3 and the bucket excavating operating amount is indicated at v4, the pilot pressure upper limit value of the arm pulling is Ppa3 from "Ca" in FIG. 17, and the pilot pressure upper limit value of the bucket excavating is Ppa4 from "Ca" in FIG. 17. On the other hand, the pilot pressure upper limit value of the boom raising is Ppa3 as the greatest value of Ppa3 and Ppb4 from "Ca" and "Cb" in FIG. 17. Further, the pilot pressure upper limit value of the other operation becomes zero.

Accordingly, the movement of the hydraulic actuator 22 in response to the boom raising movement by the area limit control part 75 is made possible even without the boom raising operation by an operator. In addition, even when the area limit control part 75 outputs the incorrect requested pilot pressure 76 due to malfunction of the area limit control part 75, the inappropriate boom raising movement can be suppressed to a speed in accordance with the lever operating amount of an operator. Further, when the operator returns the operating lever 71A back to the neutral position, it is possible to stop the inappropriate boom raising movement.

Thus, the pilot pressure upper limit determination part 78 is provided with the pilot pressure upper limit value setting table 90 as shown in FIG. 15 and a characteristic diagram 91 of the lever operating amount and the pilot pressure upper limit value as shown in FIG. 17. The pilot pressure upper limit value setting table 90 represents a corresponding relation between the lever operation performed by an operator and the pilot pressure upper limit value of each of the lever operations in response thereto. The characteristic diagram 91 of the lever operating amount and the pilot pressure upper limit value represents a corresponding relation between the lever operation amount and the pilot pressure upper limit value. In addition, the pilot pressure upper limit value setting table 90 as shown in FIG. 15 is configured as a drive signal upper limit value setting section configured to determine an upper limit value of a drive signal (pilot pressure) in accordance with the operating amount of each of the lever operations to each of the hydraulic actuators 22.

It should be noted that the drive signal upper limit value setting section is only required to set the corresponding relation between the lever operation performed by an operator and the pilot pressure upper limit value of each of the lever operations in response thereto, and is not limited to the table (matrix) as shown in FIG. 15. In addition, the pilot pressure upper limit value setting table 90 and the characteristic diagram 91 of the lever operating amount and the pilot pressure upper limit value are not limited to those in FIG. 15 and in FIG. 17, but various kinds of the drive signal upper limit value setting tables (the corresponding relation between the lever operation performed by an operator and the pilot pressure upper limit value of each of the lever operations in response thereto) and the characteristic diagram (corresponding relation between the lever operating amount and the pilot pressure upper limit value) may be set in response to the limit control of the area limit control part 75.

Figure 18:
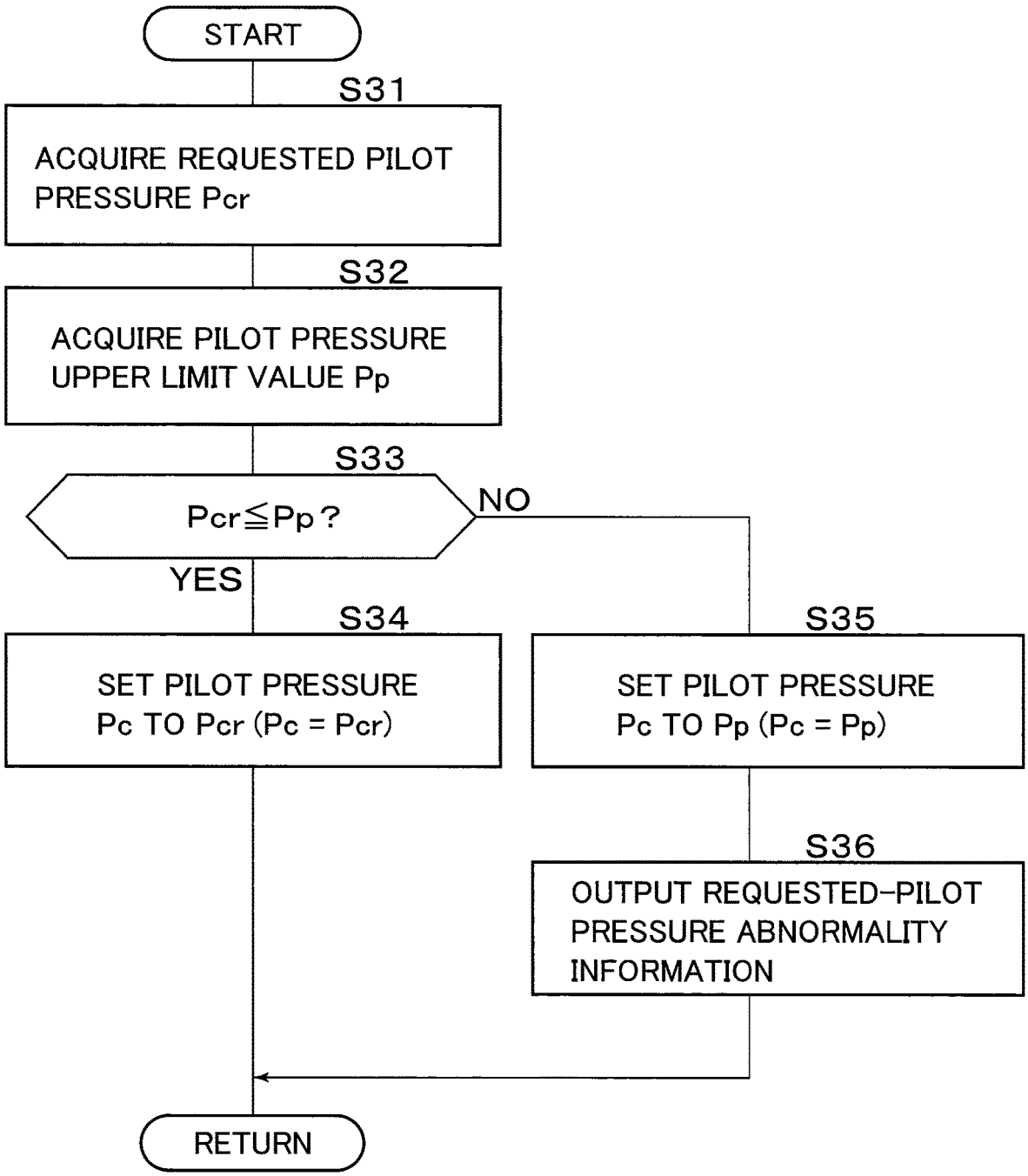
FIG. 18 is a flow chart showing processing to be executed in a pilot pressure selecting part in FIG. 14.

Next, FIG. 18 shows the control processing that is executed in the pilot pressure selecting part 80. The control processing in FIG. 18 is repeatedly executed in a predetermined control cycle during power supply to the main controller 32 (pilot pressure selecting part 80), for example.

When the control processing of the pilot pressure selecting part 80 starts, at step S31, the pilot pressure selecting part 80 acquires the requested pilot pressure 76 outputted from the area limit control part 75, that is, a requested pilot pressure Pcr. At a subsequent step S32, the pilot pressure upper limit value 79 corresponding to the upper limit value determination result outputted from the pilot pressure upper limit determination part 78, that is, a pilot pressure upper limit value Pp is acquired. At step 33, it is determined whether or not the requested pilot pressure Pcr is equal to or less than the pilot pressure upper limit value Pp.

At S33, in a case where "YES" determination is made, that is, in a case where it is determined that the requested pilot pressure Pcr is equal to or less than the pilot pressure upper limit value Pp, the process goes to S34. At S34, the requested pilot pressure Pcr is defined as the pilot pressure Pc. That is, the pilot pressure 81 is outputted as the pilot pressure Pc (=Pcr) to the solenoid valve drive part 83 and the pilot pressure abnormality detecting part 84, and the process returns (the process is back to START through RETURN, and the processing after S31 is repeated).

On the other hand, at S33, in a case where "NO" determination is made, that is, in a case where it is determined that the requested pilot pressure Pcr is greater than the pilot pressure upper limit value Pp, the process goes to S35. At S35, the requested pilot pressure Pcr is defined as the pilot pressure upper limit value Pp. That is, the pilot pressure 81 is outputted as the pilot pressure Pc (=Pb) to the solenoid valve drive part 83 and the pilot pressure abnormality detecting part 84. At subsequent S6, the requested-pilot pressure abnormality information 82 as abnormality information that the requested pilot pressure Pcr is abnormal is outputted to the abnormality notification part 88, and the process returns. These processes, that is, the processing to be executed in the pilot pressure selecting part 80 is executed to the movement in each of the hydraulic actuators 22.

Figure 19:
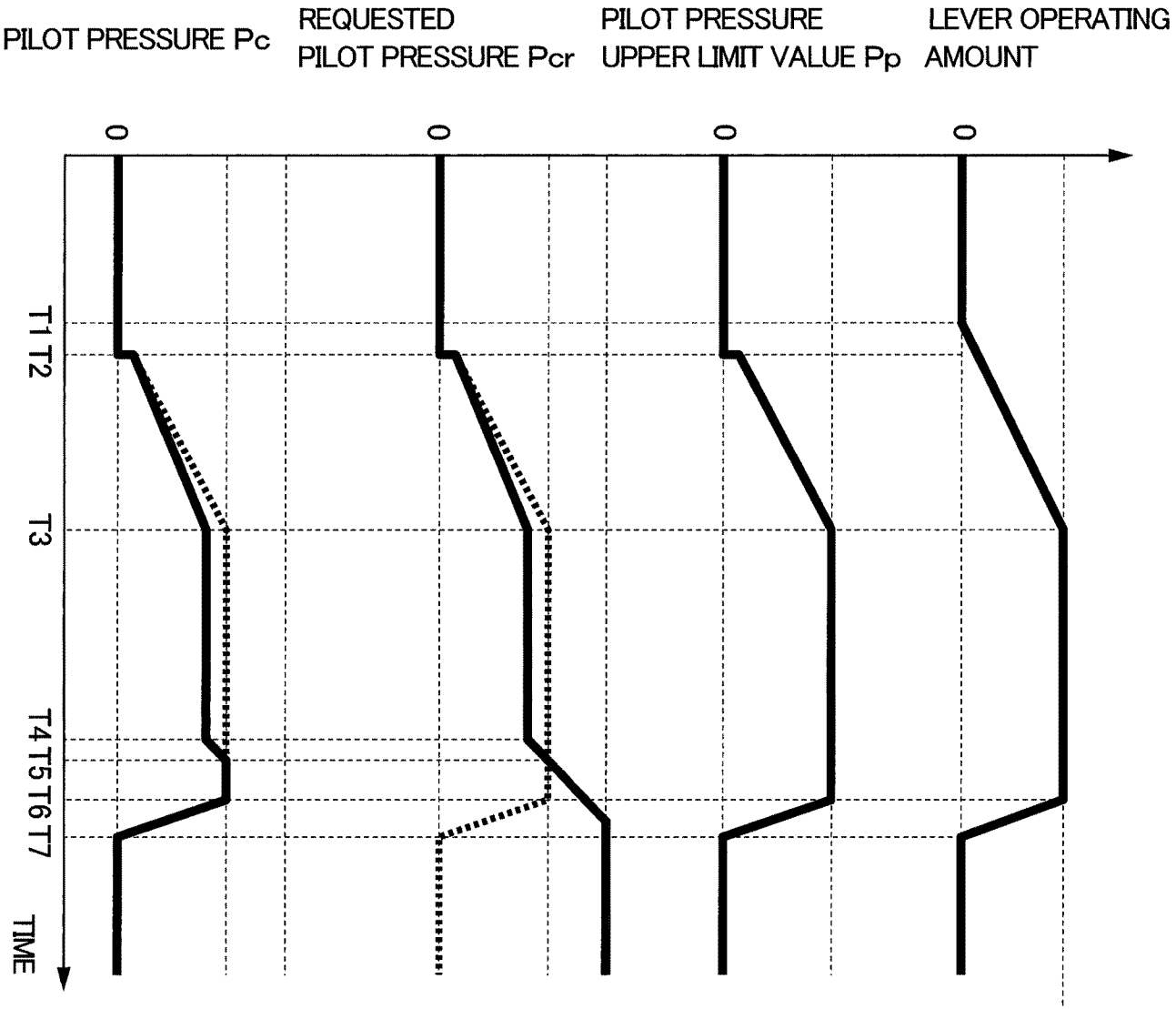
FIG. 19 is a characteristic line diagram showing an example of a change with time in lever operating amount, pilot pressure upper limit value, requested pilot pressure and pilot pressure.

Here, FIG. 19 shows a basic movement by the drive permission control part 77 when the operating lever 71A is operated. At a point of T1, an operation of the operating lever 71A by an operator is started. From a point of T2, the pilot pressure upper limit value Pp outputted from the pilot pressure upper limit determination part 78 in the drive permission control part 77 increases with an increase of the operating amount of the operating lever 71A. In addition, from a point of T2 to a point of T5, since the requested pilot pressure Pcr from the area limit control part 75 is equal to or less than the pilot pressure upper limit value Pp, the pilot pressure selecting part 80 of the drive permission control part 77 outputs the requested pilot pressure Pcr from the area limit control part 75 as the pilot pressure Pc. At this time, the solenoid valve drive part 83 of the drive permission control part 77 outputs the drive current 45 to the proportional solenoid valve 25 based upon pilot pressure Pc. Accordingly, the movement of the hydraulic actuator 22 by the vehicle body control part 73 and the area limit control part 75 is made possible.

On the other hand, when the incorrect requested pilot pressure Pcr due to the malfunction of the vehicle body control part 73 or the area limit control part 75 is outputted from a point of T4, and when the requested pilot pressure Pcr is greater than the pilot pressure upper limit value Pp from a point of T5, the pilot pressure selecting part 80 of the drive permission control part 77 outputs the pilot pressure upper limit value Pp as the pilot pressure Pc. Accordingly, at a point of T6 from a point of T5, the pilot pressure can be suppressed to the pilot pressure Pc in accordance with the lever operating amount. Further, when an operator starts to return the operating lever 71A back to the neutral position at a point of T6, at a point of T7, the pilot pressure upper limit value Pp in the pilot pressure upper limit determination part 78 of the drive permission control part 77 becomes zero. As a result, since the pilot pressure selecting part 80 of the drive permission control part 77 makes the pilot pressure Pc zero, the drive of the proportional solenoid valve 25 by the solenoid valve drive part 83 of the drive permission control part 77 stops. Accordingly, it is possible to decelerate and stop the inappropriate movement of the hydraulic actuator 22.

The second embodiment is configured to control the pilot pressure Pc to be equal to or less than the pilot pressure upper limit value Pp by the pilot pressure upper limit determination part 78 as described above, and a basic operation thereof does not differ particularly from that of the aforementioned first embodiment.

Particularly, in the second embodiment, the pilot pressure upper limit determination part 78 determines the upper limit value of the drive signal (requested pilot pressure 76) for driving the control valve 14A of each of the hydraulic actuators 22 in accordance with the operating amount of the operating lever 71A. In addition, the pilot pressure selecting part 80 drives the control valve 14A in response to the drive signal (requested pilot pressure 76) outputted from the area limit control part 75 to the hydraulic actuator 22 the drive signal (requested pilot pressure 76) of which is equal to or less than the upper limit value. On the other hand, the pilot pressure selecting part 80 selects the drive signal (requested pilot pressure 76) in such a manner as to drive the control valve 14A with the upper limit value (pilot pressure upper limit value 79) to the hydraulic actuator 22 the drive signal (requested pilot pressure 76) of which is beyond the upper limit value. Therefore, when an operator operates the operating lever 71A, it is possible to permit not only the drive of the hydraulic actuator 22 corresponding to the operating lever 71A but also the drive of the hydraulic actuator 22 required for moving the machine such that the working mechanism 5 does not deviate from the predetermined spacious area. Together with it, even when the incorrect drive signal (requested pilot pressure 76) is outputted from the area limit control part 75, since the drive signal is suppressed to a drive signal in accordance with the lever operating amount 72 by an operator, that is, the pilot pressure upper limit value 79, a speed change of the machine can be suppressed. Further, when an operator sets the operating lever 71A to a neutral position, even when the area limit control part 75 outputs the incorrect drive signal (requested pilot pressure 76), the drive signal is suppressed to zero of the pilot pressure upper limit value 79. Accordingly, the drive of the hydraulic actuator 22 is not permitted, thus making it possible to stop the machine.

In the second embodiment, it is possible to set the upper limit value (pilot pressure upper limit value 79) of the drive signal in accordance with the operating amount of each of the lever operations to each of the hydraulic actuators 22 by the pilot pressure upper limit value setting table 90 in FIG. 15 corresponding to the drive signal upper limit setting section. Therefore, it is possible to set the upper limit value of the drive signal suitable for the configuration of the working mechanism 5 and the upper limit value of the drive signal suitable for the spacious area for preventing deviation of the working mechanism 5.

The second embodiment is provided with the pilot pressure selecting part 80 and the abnormality notification part 88 as the requested-pilot pressure abnormality detecting section.

Therefore, it is possible to perform detection and notification of the control abnormality based upon the drive signal (requested pilot pressure 76) of each of the hydraulic actuators 22 and the upper limit value (pilot pressure upper limit value 79) outputted by the pilot pressure upper limit determination part 78. Thereby, it is possible to encourage an operator to repair the machine.

It should be noted that the aforementioned first embodiment is explained by taking a case where the vehicle body control part 36, the area limit control part 40 and the drive permission control part 44 are mounted in the single main controller 32, as an example. However, the present invention is not limited thereto, but, for example, the area limit control part 40 and the drive permission control part 44 may be mounted in a controller different from the main controller 32 in which the vehicle body control part 36 is mounted. In addition, the vehicle body control part 36, the area limit control part 40 and the drive permission control part 44 may be respectively mounted in different controllers. This configuration can be applied likewise to the second embodiment.

The aforementioned first embodiment is explained by taking a case of moving the boom 5A in the raising direction to prevent excavating the side deeper than the target surface 61 and a case of moving the arm 5B in the pushing direction to prevent the bucket 5C from entering the interference prevention area 63 as the control performed in the area limit control part 40, as an example. However, the present invention is not limited thereto, but for example, the control section (area limit control section) may be configured, in addition to the above, to perform various kinds of control to prevent the machine from deviating from the predetermined space area, such as avoidance of collision of the machine upper side with facilities in the working site and the like. This configuration can be applied likewise to the second embodiment.

The aforementioned first embodiment is explained by taking a case where the hydraulic actuator 22 is operated using the operating lever 15A, as an example. However, the present invention is not limited thereto, but, for example, the hydraulic actuator 22 may be operated using various kinds of operating devices such as an operating pedal or an operating stick and the like. That is, the operating lever includes various kinds of operating devices. This configuration can be applied likewise to the second embodiment.

The aforementioned first embodiment is explained by taking a case where the drive signal for driving the control valve 14A is adopted as the pilot pressure (hydraulic pressure), as an example. However, the present invention is not limited thereto, but, for example, various kinds of drive signals other than the hydraulic pressure may be used, such as adopting a solenoid valve as the control valve and adopting an electrical signal as the drive signal and the like. This configuration can be applied likewise to the second embodiment.

The aforementioned first embodiment is explained by taking a case where the drive source of the revolving device 3 is configured of the revolving hydraulic motor 3A, as an example. However, the present invention is not limited thereto, but, the drive source of the revolving device may be configured of, for example, a hydraulic motor (revolving hydraulic motor) and an electric motor (revolving electric motor). In addition, the drive source of the revolving device may be configured of an electric motor (revolving electric motor) only. This configuration can be applied likewise to the second embodiment.

Each of the aforementioned embodiments is explained by taking a case where the hydraulic excavator 1 is adopted as the construction machine, as an example. However, the present invention is not limited thereto, for example, but the present invention may be widely applied to various types of construction machines such as a wheel loader. Further, each of the embodiments is disclosed as only an example and a partial replacement or a combination of the configurations in the different embodiments can be made without mentioning.

According to the above embodiments, it is possible to stop the machine by setting the operating lever to a neutral position whether the control section is normal or not, and it is possible to control the working mechanism from deviating from the predetermined spacious area.

(1) That is, according to the embodiment, it is configured to includes the drive permission determination section and the drive signal selecting section. In addition, the drive signal selecting section is configured to select the drive signal in such a manner as not to drive the control valve to the hydraulic actuator the drive of which is not permitted by the drive permission determination section. In this case, the drive permission determination section can prevent the drives of all the hydraulic actuators from being permitted when the operating lever is in the neutral position. Accordingly, when an operator sets the operating lever to the neutral position, the drive permission determination section selects the drive signal not to drive the control valve even if an abnormal drive signal is outputted. As a result, it is possible to stop the machine by setting the operating lever to the neutral position, without mentioning when there is no presence of the abnormal drive signal, and even if there is presence of the abnormal drive signal.

On the other hand, when the operating lever is operated from the neutral position, the drive permission determination section can permit the drive of the hydraulic actuator required for controlling the working mechanism from deviating from the predetermined spacious area to the operating lever. Accordingly, even if the abnormal drive signal (for example, drive signal other than the drive signal for controlling the working mechanism from deviating from the predetermined spacious area) is present, the drive signal selecting section is configured to select the drive signal to the hydraulic actuator the drive of which is permitted by the drive permission determination section without selecting the abnormal drive signal. Asa result, it is possible to control the working mechanism from deviating from the predetermined spacious area, without mentioning when there is no presence of the abnormal drive signal, and also even if there is presence of the abnormal drive signal.

(2) According to the embodiment, the drive permission determination section is configured to include the drive permission setting section. In this case, the drive permission setting section may be set as the corresponding relation between the lever operation and the movement of the actuator the drive of which is permitted to the lever operation. That is, the drive permission setting section may set the drive permission suitable for the configuration of the working mechanism and/or the drive permission suitable for the spacious area for preventing the deviation of the working mechanism. Accordingly, the drive permission determination section can appropriately and stably determine whether to permit the drive of each of the hydraulic actuators.

(3) According to the embodiment, it is configured to further include the abnormality detecting section and the abnormality notification section. Accordingly, it is possible to notify an operator of the abnormality and further, to automatically stop the machine. Asa result, it is possible to encourage an operator to repair the machine.

(4) According to the embodiment, it is configured to include the drive signal upper limit determination section and the drive signal selecting section. In addition, the drive signal selecting section selects the drive signal in such a manner as to drive the control valve with the upper limit value to the hydraulic actuator the drive signal of which is beyond the upper limit value determined in the drive signal upper limit determination section. In this case, the drive signal upper limit determination section can make the upper limit values of the drive signals to all the hydraulic actuators zero when the operating lever is in the neutral position. Accordingly, when an operator sets the operating lever to the neutral position, the drive signal selecting section selects the drive signal as zero that is the upper limit value even if there is present the abnormal drive signal. As a result, it is possible to stop the machine by setting the operating lever to the neutral position, without mentioning when there is no presence of the abnormal drive signal, and even if there is presence of the abnormal drive signal.

On the other hand, when the operating lever is operated from the neutral position, the drive signal upper limit determination section can determine the upper limit value of the drive signal to be capable of driving the hydraulic actuator required for controlling the working mechanism from deviating from the predetermined spacious area to the lever operation.

Accordingly, even if there is present the abnormal drive signal (for example, drive signal exceeding the upper limit value of the drive signal for controlling the working mechanism from deviating from the predetermined spacious area), the drive signal selecting section is configured to select the upper limit value of the drive signal determined by the drive signal upper limit determination section. As a result, it is possible to control the working mechanism from deviating from the predetermined spacious area, without mentioning when there is not present the abnormal drive signal, and also even if there is present the abnormal drive signal.

(5) According to the embodiment, the drive signal upper limit determination section is configured to include the drive signal upper limit value setting section. In this case, the drive signal upper limit determination section may be set as the corresponding relation between the lever operation and the upper limit value of the drive signal to the actuator the drive of which is permitted to the lever operation. That is, the drive signal upper limit determination section may set the upper limit value of the drive signal suitable for the configuration of the working mechanism and/or the upper limit value of the drive signal suitable for the spacious area for preventing the deviation of the working mechanism. Accordingly, the drive signal upper limit determination section can appropriately and stably determine the upper limit value to each of the hydraulic actuators.

(6) According to the embodiment, it is configured to further include the abnormality detecting section and the abnormality notification section. Accordingly, it is possible to notify an operator of the abnormality and further, to automatically stop the machine. Asa result, it is possible to encourage an operator to repair the machine.

DESCRIPTION OF REFERENCE NUMERALS

1: Hydraulic excavator (Construction machine)
2: Lower traveling structure (Machine)
2E: Traveling hydraulic motor (Hydraulic actuator)
3: Revolving device (Machine)
3A: Revolving hydraulic motor (Hydraulic actuator)
4: Upper revolving structure (Machine)
5: Working mechanism (Machine)
5D: Boom cylinder (Hydraulic actuator)
5E: Arm cylinder (Hydraulic actuator)
5F: Bucket cylinder (Hydraulic actuator)
14: Control valve device
14A: Control valve
15: Operating lever device
15A: Operating lever
28: Pressure sensor (Operating amount measuring section)
31: Posture sensor (Posture measuring section)
32: Main controller
40, 75: Area limit control part (Control section)
48: Drive permission determination part (Drive permission determination section)
50, 80: Pilot pressure selecting part (Drive signal selecting section, Abnormality detecting section)
58, 88: Abnormality notification part (Abnormality notification section)
60, 62: Drive permission setting table (Drive permission setting section)
71: Operating lever device (Operating amount measuring section)
71A: Operating lever
73: Vehicle body control part (Control section)
78: Pilot pressure upper limit determination part (Drive signal upper limit determination section)
90: Pilot pressure upper limit value setting table (Drive signal upper limit setting section)

The invention claimed is:

1. A drive control device for a construction machine that outputs a drive signal for driving each of control valves in each of a plurality of hydraulic actuators to a boost proportional solenoid valve that increases a pilot pressure to be delivered to said control valve to activate or speed up each of said hydraulic actuators, based upon a signal from an operating amount measuring section configured to output an operating signal in accordance with an operating amount of each of a plurality of operating levers for operating said hydraulic actuators, and a signal from a posture measuring section configured to output a posture signal in accordance with a posture of said construction machine, said drive control device for the construction machine includes:

an area limit control section connected to both said posture measuring section and said operating amount measuring section, configured to estimate the posture of said construction machine based upon the signal from said posture measuring section, and output said drive signal to prevent said construction machine from deviating from the predetermined space area by calculating said operating amount based upon the signal from said operating amount measuring section, a drive permission determination section configured to include a drive permission setting table representing a corresponding relation between a preset lever operation of an operator and a drive permission target to prevent said construction machine from deviating from the predetermined space area, determine whether or not a drive of each of said hydraulic actuators is permitted based upon said drive permission setting table and said operating signal, and determine the drive of each of said hydraulic actuators as not-permitted when said operating lever is in a neutral position;

a drive signal selecting section configured to select said drive signal in such a manner as to drive said control valve through said boost proportional solenoid valve with said drive signal to said hydraulic actuator, the drive of which is permitted by said drive permission determination section out of each of said hydraulic actuators, and not to drive said control valve through said boost proportional solenoid valve even if there is presence of an abnormal drive signal to said hydraulic actuator, the drive of which is not permitted by said drive permission determination section out of each of said hydraulic actuators;

an abnormality detecting section configured to detect control abnormality based upon said drive signal of each of said hydraulic actuators and a drive permission signal determined by said drive permission determination section; and a drive signal stopping section configured to block said pilot pressure to said control valve when said control abnormality is detected by said abnormality detecting section.

2. The drive control device for the construction machine according to claim 1, wherein said drive permission determination section includes a drive permission setting section configured to set one or a plurality of lever operations for permitting the drive to each of said hydraulic actuators.

3. The drive control device for the construction machine according to claim 1, further comprising:

an abnormality notification section configured to notify abnormality when said control abnormality is detected by said abnormality detecting section.

4. A drive control device for a construction machine that outputs a drive signal for driving each of control valves in each of a plurality of hydraulic actuators to a boost proportional solenoid valve that increases a pilot pressure to be delivered to said control valve to activate or speed up each of said hydraulic actuators, based upon a signal from an operating amount measuring section configured to output an operating signal in accordance with an operating amount of each of a plurality of operating levers for operating said hydraulic actuators, and a signal from a posture measuring section configured to output a posture signal in accordance with a posture of said construction machine, said drive control device for the construction machine includes:

an area limit control section connected to both said posture measuring section and said operating amount measuring section, configured to estimate the posture of said construction machine based upon the signal from said posture measuring section, and output said drive signal to prevent said construction machine from deviating from the predetermined space area by calculating said operating amount based upon the signal from said operating amount measuring section, a drive signal upper limit determination section configured to include an upper limit value setting table representing a corresponding relation between a preset lever operation of an operator and an upper limit value of said drive signal for driving each of said control valves to prevent said construction machine from deviating from the predetermined space area, and determine the upper limit value of said drive signal for driving each of said control valves based upon said upper limit value setting table and said operating signal and determine the upper limit value of said drive signal as zero when said operating lever is in a neutral position;

a drive signal selecting section configured to select said drive signal in such a manner as to drive said control valve through said boost proportional solenoid valve with said drive signal to said hydraulic actuator, the drive signal of which is equal to or less than an upper limit value determined by said drive signal upper limit determination section out of each of said hydraulic actuators, and to drive said control valve through said boost proportional solenoid valve with said upper limit value even if there is a presence of an abnormal drive signal to said hydraulic actuator the drive signal of which is beyond the upper limit value determined by said drive signal upper limit determination section out of each of said hydraulic actuators;

an abnormality detecting section configured to detect control abnormality based upon said drive signal of each of said hydraulic actuators and the upper limit value of said drive signal determined by said drive signal upper limit determination section; and a drive signal stopping section configured to block said pilot pressure to said control valve when said control abnormality is detected by said abnormality detecting section, said drive signal upper limit determination section determines the upper limit value of said drive signal in accordance with each of said hydraulic actuators including said hydraulic actuator moved by one of said operating levers which is operated.

5. The drive control device for the construction machine according to claim 4, wherein said drive signal upper limit determination section includes a drive signal upper limit value setting section configured to determine an upper limit value of said drive signal in accordance with an operating amount of each of lever operations to each of said hydraulic actuators.

6. The drive control device for the construction machine according to claim 4, further comprising:

an abnormality notification section configured to notify abnormality when said control abnormality is detected by said abnormality detecting section.

* * * * *